US007407264B2

(12) United States Patent
Kuwahara et al.

(10) Patent No.: US 7,407,264 B2
(45) Date of Patent: Aug. 5, 2008

(54) LIQUID DISCHARGING APPARATUS AND LIQUID DISCHARGING METHOD

(75) Inventors: Soichi Kuwahara, Kanagawa (JP); Hiroshi Udagawa, Tokyo (JP)

(73) Assignee: Sony Corporation (JP)

( * ) Notice: Subject to any disclaimer, the term of this patent is extended or adjusted under 35 U.S.C. 154(b) by 105 days.

(21) Appl. No.: 10/670,526

(22) Filed: Sep. 26, 2003

(65) Prior Publication Data

US 2005/0073546 A1 Apr. 7, 2005

(30) Foreign Application Priority Data

Oct. 1, 2002 (JP) ..... P2002-288442
Nov. 29, 2002 (JP) ..... P2002-348148

(51) Int. Cl.
*B41J 2/14* (2006.01)
*B41J 2/16* (2006.01)

(52) U.S. Cl. ..... 347/48; 347/65; 347/14

(58) Field of Classification Search ..... 347/14, 347/19, 43, 55, 48, 65; 358/1.9
See application file for complete search history.

(56) References Cited

U.S. PATENT DOCUMENTS 6,046,822 A * 4/2000 Wen et al. ..... 358/1.9
6,264,298 B1 7/2001 Mantell
6,270,187 B1 * 8/2001 Murcia et al. ..... 347/43
6,270,199 B1 * 8/2001 Kimura et al. ..... 347/65
6,309,050 B1 * 10/2001 Ikeda et al. ..... 347/55
6,428,139 B1 8/2002 Silverbrook ..... 347/19
2004/0036723 A1 * 2/2004 Eguchi et al. ..... 347/9

FOREIGN PATENT DOCUMENTS

| | | | |
|---|---|---|---|
| EP | 0694396 | A2 | 1/1996 |
| EP | 0 963 854 | A2 | 12/1999 |
| EP | 1 205 308 | A | 5/2002 |
| JP | 2000185403 | | 7/2000 |
| JP | 2002-036522 | | 2/2002 |
| JP | 2002-240287 | | 8/2002 |
| WO | WO 02 02329 | A1 | 1/2002 |
| WO | WO 02/02330 | A1 | 1/2002 |

OTHER PUBLICATIONS

EPO Search Report Dec. 15, 2003.

* cited by examiner

*Primary Examiner*—Lam S Nguyen
(74) *Attorney, Agent, or Firm*—Rader Fishman & Grauer PLLC; Ronald P. Kananen

(57) ABSTRACT

In a liquid discharging method for discharging droplets from a plurality of droplet discharging portions of a liquid discharging head, an actual pattern is created to indicate the discharging states of the droplets from the liquid discharging portions, and information about a defective liquid discharging portion having discharging failure is obtained by checking the discharging states. According to the information, the defective liquid discharging portion is prohibited form discharging, and discharging of droplets from a liquid discharging portion near the defective liquid discharging portion is controlled to reduce the influence of discharging failure of the defective discharging portion, and to correct image information on a recording medium.

14 Claims, 27 Drawing Sheets

FIG. 9

| ORIGINAL PRINT INFORMATION | | | ODD LINE | | | EVEN LINE | | |
|---|---|---|---|---|---|---|---|---|
| $A_{n-1}$ | $A_n$ | $A_{n+1}$ | $B_{n-1}$ | $B_n$ | $B_{n+1}$ | $B_{n-1}$ | $B_n$ | $B_{n+1}$ |
| 0 | 0 | 0 | 0 | 0 | 0 | 0 | 0 | 0 |
| 0 | 0 | 1 | 0 | 0 | 1 | 0 | 0 | 1 |
| 0 | 0 | 2 | 0 | 0 | 2 | 0 | 0 | 2 |
| 0 | 0 | 3 | 0 | 0 | 3 | 0 | 0 | 3 |
| 0 | 0 | 4 | 0 | 0 | 4 | 0 | 0 | 4 |
| 0 | 0 | 5 | 0 | 0 | 5 | 0 | 0 | 5 |
| 0 | 1 | 0 | 0 | 0 | 1 | 0 | 0 | 1 |
| 0 | 1 | 1 | 0 | 0 | 2 | 0 | 0 | 2 |
| 0 | 1 | 2 | 0 | 0 | 3 | 0 | 0 | 3 |
| 0 | 1 | 3 | 0 | 0 | 4 | 0 | 0 | 4 |
| 0 | 1 | 4 | 0 | 0 | 5 | 0 | 0 | 5 |
| 0 | 1 | 5 | 0 | 0 | 6 | 0 | 0 | 6 |
| 0 | 2 | 0 | 0 | 0 | 2 | 0 | 0 | 2 |
| 0 | 2 | 1 | 0 | 0 | 3 | 0 | 0 | 3 |
| 0 | 2 | 2 | 0 | 0 | 4 | 0 | 0 | 4 |
| 0 | 2 | 3 | 0 | 0 | 5 | 0 | 0 | 5 |
| 0 | 2 | 4 | 0 | 0 | 6 | 0 | 0 | 6 |
| 0 | 2 | 5 | 0 | 0 | 7 | 0 | 0 | 7 |
| 0 | 3 | 0 | 0 | 0 | 3 | 0 | 0 | 3 |
| 0 | 3 | 1 | 0 | 0 | 4 | 0 | 0 | 4 |
| 0 | 3 | 2 | 0 | 0 | 5 | 0 | 0 | 5 |
| 0 | 3 | 3 | 0 | 0 | 6 | 0 | 0 | 6 |
| 0 | 3 | 4 | 0 | 0 | 7 | 0 | 0 | 7 |
| 0 | 3 | 5 | 0 | 0 | 8 | 0 | 0 | 8 |
| 0 | 4 | 0 | 0 | 0 | 4 | 0 | 0 | 4 |
| 0 | 4 | 1 | 0 | 0 | 5 | 0 | 0 | 5 |
| 0 | 4 | 2 | 0 | 0 | 6 | 0 | 0 | 6 |
| 0 | 4 | 3 | 0 | 0 | 7 | 0 | 0 | 7 |
| 0 | 4 | 4 | 0 | 0 | 8 | 0 | 0 | 8 |
| 0 | 4 | 5 | 0 | 0 | 8 | 0 | 0 | 8 |
| 0 | 5 | 0 | 0 | 0 | 5 | 0 | 0 | 5 |
| 0 | 5 | 1 | 0 | 0 | 6 | 0 | 0 | 6 |
| 0 | 5 | 2 | 0 | 0 | 7 | 0 | 0 | 7 |
| 0 | 5 | 3 | 0 | 0 | 8 | 0 | 0 | 8 |
| 0 | 5 | 4 | 0 | 0 | 8 | 0 | 0 | 8 |

FIG. 10

| ORIGINAL PRINT INFORMATION | | | ODD LINE | | | EVEN LINE | | |
|---|---|---|---|---|---|---|---|---|
| $A_{n-1}$ | $A_n$ | $A_{n+1}$ | $B_{n-1}$ | $B_n$ | $B_{n+1}$ | $B_{n-1}$ | $B_n$ | $B_{n+1}$ |
| 0 | 5 | 5 | 0 | 0 | 8 | 0 | 0 | 8 |
| 1 | 0 | 0 | 1 | 0 | 0 | 1 | 0 | 0 |
| 1 | 0 | 1 | 1 | 0 | 1 | 1 | 0 | 1 |
| 1 | 0 | 2 | 1 | 0 | 2 | 1 | 0 | 2 |
| 1 | 0 | 3 | 1 | 0 | 3 | 1 | 0 | 3 |
| 1 | 0 | 4 | 1 | 0 | 4 | 1 | 0 | 4 |
| 1 | 0 | 5 | 1 | 0 | 5 | 1 | 0 | 5 |
| 1 | 1 | 0 | 2 | 0 | 0 | 2 | 0 | 0 |
| 1 | 1 | 1 | 1 | 0 | 2 | 2 | 0 | 1 |
| 1 | 1 | 2 | 1 | 0 | 3 | 1 | 0 | 3 |
| 1 | 1 | 3 | 1 | 0 | 4 | 2 | 0 | 3 |
| 1 | 1 | 4 | 1 | 0 | 5 | 2 | 0 | 4 |
| 1 | 1 | 5 | 1 | 0 | 6 | 2 | 0 | 5 |
| 1 | 2 | 0 | 3 | 0 | 0 | 3 | 0 | 0 |
| 1 | 2 | 1 | 2 | 0 | 3 | 3 | 0 | 2 |
| 1 | 2 | 2 | 2 | 0 | 4 | 3 | 0 | 3 |
| 1 | 2 | 3 | 2 | 0 | 5 | 3 | 0 | 4 |
| 1 | 2 | 4 | 2 | 0 | 6 | 3 | 0 | 5 |
| 1 | 2 | 5 | 2 | 0 | 7 | 3 | 0 | 6 |
| 1 | 3 | 0 | 4 | 0 | 0 | 4 | 0 | 0 |
| 1 | 3 | 1 | 3 | 0 | 4 | 4 | 0 | 3 |
| 1 | 3 | 2 | 3 | 0 | 5 | 4 | 0 | 4 |
| 1 | 3 | 3 | 3 | 0 | 6 | 4 | 0 | 5 |
| 1 | 3 | 4 | 3 | 0 | 7 | 4 | 0 | 6 |
| 1 | 3 | 5 | 3 | 0 | 8 | 4 | 0 | 7 |
| 1 | 4 | 0 | 5 | 0 | 0 | 5 | 0 | 0 |
| 1 | 4 | 1 | 4 | 0 | 5 | 5 | 0 | 4 |
| 1 | 4 | 2 | 4 | 0 | 6 | 5 | 0 | 5 |
| 1 | 4 | 3 | 4 | 0 | 7 | 5 | 0 | 6 |
| 1 | 4 | 4 | 4 | 0 | 8 | 5 | 0 | 7 |
| 1 | 4 | 5 | 4 | 0 | 8 | 5 | 0 | 8 |
| ⋮ | ⋮ | ⋮ | ⋮ | ⋮ | ⋮ | ⋮ | ⋮ | ⋮ |
| 5 | 5 | 5 | 8 | 0 | 8 | 8 | 0 | 8 |

FIG. 22

| | | $D_1$ | $D_2$ | $D_3$ | $D_4$ | $D_5$ | $D_6$ | $D_7$ | $D_8$ | $D_9$ |
|---|---|---|---|---|---|---|---|---|---|---|
| A | PNM1 | DP1 | DP2 | DP3 | DP4 | DP5 | DP6 | DP7 | DP8 | DP9 |
| | PNM2 | DP-1 | DP1 | DP2 | DP3 | DP4 | DP5 | DP6 | DP7 | DP8 |
| | PNM3 | DP-2 | DP-1 | DP1 | DP2 | DP3 | DP4 | DP5 | DP6 | DP7 |
| | PNM4 | DP-3 | DP-2 | DP-1 | DP1 | DP2 | DP3 | DP4 | DP5 | DP6 |
| | PNM5 | DP-4 | DP-3 | DP-2 | DP-1 | DP1 | DP2 | DP3 | DP4 | DP5 |
| | PNM6 | DP-5 | DP-4 | DP-3 | DP-2 | DP-1 | DP1 | DP2 | DP3 | DP4 |
| | PNM7 | DP-6 | DP-5 | DP-4 | DP-3 | DP-2 | DP-1 | DP1 | DP2 | DP3 |
| B | PNM1 | DP-7 | DP-6 | DP-5 | DP-4 | DP-3 | DP-2 | DP-1 | DP1 | DP2 |
| | PNM2 | DP1 | DP2 | DP3 | DP4 | DP5 | DP6 | DP7 | DP8 | DP9 |
| | PNM3 | DP-1 | DP1 | DP2 | DP3 | DP4 | DP5 | DP6 | DP7 | DP8 |
| | PNM4 | DP-2 | DP-1 | DP1 | DP2 | DP3 | DP4 | DP5 | DP6 | DP7 |
| | PNM5 | DP-3 | DP-2 | DP-1 | DP1 | DP2 | DP3 | DP4 | DP5 | DP6 |
| | PNM6 | DP-4 | DP-3 | DP-2 | DP-1 | DP1 | DP2 | DP3 | DP4 | DP5 |
| | PNM7 | DP-5 | DP-4 | DP-3 | DP-2 | DP-1 | DP1 | DP2 | DP3 | DP4 |
| C | PNM1 | DP-6 | DP-5 | DP-4 | DP-3 | DP-2 | DP-1 | DP1 | DP2 | DP3 |
| | PNM2 | DP-7 | DP-6 | DP-5 | DP-4 | DP-3 | DP-2 | DP-1 | DP1 | DP2 |
| | PNM3 | DP1 | DP2 | DP3 | DP4 | DP5 | DP6 | DP7 | DP8 | DP9 |
| | PNM4 | DP-1 | DP1 | DP2 | DP3 | DP4 | DP5 | DP6 | DP7 | DP8 |
| | PNM5 | DP-2 | DP-1 | DP1 | DP2 | DP3 | DP4 | DP5 | DP6 | DP7 |
| | PNM6 | DP-3 | DP-2 | DP-1 | DP1 | DP2 | DP3 | DP4 | DP5 | DP6 |
| | PNM7 | DP-4 | DP-3 | DP-2 | DP-1 | DP1 | DP2 | DP3 | DP4 | DP5 |
| D | PNM1 | DP-5 | DP-4 | DP-3 | DP-2 | DP-1 | DP1 | DP2 | DP3 | DP4 |
| | PNM2 | DP-6 | DP-5 | DP-4 | DP-3 | DP-2 | DP-1 | DP1 | DP2 | DP3 |
| | PNM3 | DP-7 | DP-6 | DP-5 | DP-4 | DP-3 | DP-2 | DP-1 | DP1 | DP2 |
| | PNM4 | DP1 | DP2 | DP3 | DP4 | DP5 | DP6 | DP7 | DP8 | DP9 |
| | PNM5 | DP-1 | DP1 | DP2 | DP3 | DP4 | DP5 | DP6 | DP7 | DP8 |
| | PNM6 | DP-2 | DP-1 | DP1 | DP2 | DP3 | DP4 | DP5 | DP6 | DP7 |
| | PNM7 | DP-3 | DP-2 | DP-1 | DP1 | DP2 | DP3 | DP4 | DP5 | DP6 |
| E | PNM1 | DP-4 | DP-3 | DP-2 | DP-1 | DP1 | DP2 | DP3 | DP4 | DP5 |
| | PNM2 | DP-5 | DP-4 | DP-3 | DP-2 | DP-1 | DP1 | DP2 | DP3 | DP4 |
| | PNM3 | DP-6 | DP-5 | DP-4 | DP-3 | DP-2 | DP-1 | DP1 | DP2 | DP3 |
| | PNM4 | DP-7 | DP-6 | DP-5 | DP-4 | DP-3 | DP-2 | DP-1 | DP1 | DP2 |
| | PNM5 | DP1 | DP2 | DP3 | DP4 | DP5 | DP6 | DP7 | DP8 | DP9 |
| | PNM6 | DP-1 | DP1 | DP2 | DP3 | DP4 | DP5 | DP6 | DP7 | DP8 |
| | PNM7 | DP-2 | DP-1 | DP1 | DP2 | DP3 | DP4 | DP5 | DP6 | DP7 |
| F | PNM1 | DP-3 | DP-2 | DP-1 | DP1 | DP2 | DP3 | DP4 | DP5 | DP6 |
| | PNM2 | DP-4 | DP-3 | DP-2 | DP-1 | DP1 | DP2 | DP3 | DP4 | DP5 |
| | PNM3 | DP-5 | DP-4 | DP-3 | DP-2 | DP-1 | DP1 | DP2 | DP3 | DP4 |
| | PNM4 | DP-6 | DP-5 | DP-4 | DP-3 | DP-2 | DP-1 | DP1 | DP2 | DP3 |
| | PNM5 | DP-7 | DP-6 | DP-5 | DP-4 | DP-3 | DP-2 | DP-1 | DP1 | DP2 |
| | PNM6 | DP1 | DP2 | DP3 | DP4 | DP5 | DP6 | DP7 | DP8 | DP9 |
| | PNM7 | DP-1 | DP1 | DP2 | DP3 | DP4 | DP5 | DP6 | DP7 | DP8 |

FIG. 23

| | | $D_1$ | $D_2$ | $D_3$ | $D_4$ | $D_5$ | $D_6$ | $D_7$ | $D_8$ | $D_9$ |
|---|---|---|---|---|---|---|---|---|---|---|
| A | PNM1 | PNM2 | PMN1 | PMN1 | PMN1 | PMN1 | PMN1 | PMN1 | PMN1 | PMN1 |
| | PNM2 | PNM3 | PNM3 | PNM2 | PNM2 | PNM2 | PNM2 | PNM2 | PNM2 | PNM2 |
| | PNM3 | PNM4 | PNM4 | PNM4 | PNM3 | PNM3 | PNM3 | PNM3 | PNM3 | PNM3 |
| | PNM4 | PNM5 | PNM5 | PNM5 | PNM5 | PNM4 | PNM4 | PNM4 | PNM4 | PNM4 |
| | PNM5 | PNM6 | PNM6 | PNM6 | PNM6 | PNM6 | PNM5 | PNM5 | PNM5 | PNM5 |
| | PNM6 | PNM7 | PNM7 | PNM7 | PNM7 | PNM7 | PNM7 | PNM6 | PNM6 | PNM6 |
| | PNM7 | PNM7 | PNM7 | PNM7 | PNM7 | PNM7 | PNM7 | PNM7 | PNM7 | PNM7 |
| B | PNM1 | PMN1 | PMN1 | PMN1 | PMN1 | PMN1 | PMN1 | PMN1 | PNM2 | PMN1 |
| | PNM2 | PNM3 | PNM2 | PNM2 | PNM2 | PNM2 | PNM2 | PNM2 | PNM3 | PNM2 |
| | PNM3 | PNM4 | PNM4 | PNM3 | PNM3 | PNM3 | PNM3 | PNM3 | PNM4 | PNM3 |
| | PNM4 | PNM5 | PNM5 | PNM5 | PNM4 | PNM4 | PNM4 | PNM4 | PNM5 | PNM4 |
| | PNM5 | PNM6 | PNM6 | PNM6 | PNM6 | PNM5 | PNM5 | PNM5 | PNM6 | PNM5 |
| | PNM6 | PNM7 | PNM7 | PNM7 | PNM7 | PNM7 | PNM6 | PNM6 | PNM7 | PNM6 |
| | PNM7 | PNM7 | PNM7 | PNM7 | PNM7 | PNM7 | PNM7 | PNM7 | PNM7 | PNM7 |
| C | PNM1 | PMN1 | PMN1 | PMN1 | PMN1 | PMN1 | PMN1 | PNM2 | PMN1 | PMN1 |
| | PNM2 | PNM2 | PNM2 | PNM2 | PNM2 | PNM2 | PNM2 | PNM3 | PNM3 | PNM2 |
| | PNM3 | PNM4 | PNM3 | PNM3 | PNM3 | PNM3 | PNM3 | PNM4 | PNM4 | PNM3 |
| | PNM4 | PNM5 | PNM5 | PNM4 | PNM4 | PNM4 | PNM4 | PNM5 | PNM5 | PNM4 |
| | PNM5 | PNM6 | PNM6 | PNM6 | PNM5 | PNM5 | PNM5 | PNM6 | PNM6 | PNM5 |
| | PNM6 | PNM7 | PNM7 | PNM7 | PNM7 | PNM6 | PNM6 | PNM7 | PNM7 | PNM6 |
| | PNM7 | PNM7 | PNM7 | PNM7 | PNM7 | PNM7 | PNM7 | PNM7 | PNM7 | PNM7 |
| D | PNM1 | PMN1 | PMN1 | PMN1 | PMN1 | PMN1 | PNM2 | PMN1 | PMN1 | PMN1 |
| | PNM2 | PNM2 | PNM2 | PNM2 | PNM2 | PNM2 | PNM3 | PNM3 | PNM2 | PNM2 |
| | PNM3 | PNM3 | PNM3 | PNM3 | PNM3 | PNM3 | PNM4 | PNM4 | PNM4 | PNM3 |
| | PNM4 | PNM5 | PNM4 | PNM4 | PNM4 | PNM4 | PNM5 | PNM5 | PNM5 | PNM4 |
| | PNM5 | PNM6 | PNM6 | PNM5 | PNM5 | PNM5 | PNM6 | PNM6 | PNM6 | PNM5 |
| | PNM6 | PNM7 | PNM7 | PNM7 | PNM6 | PNM6 | PNM7 | PNM7 | PNM7 | PNM6 |
| | PNM7 | PNM7 | PNM7 | PNM7 | PNM7 | PNM7 | PNM7 | PNM7 | PNM7 | PNM7 |
| E | PNM1 | PMN1 | PMN1 | PMN1 | PMN1 | PNM2 | PMN1 | PMN1 | PMN1 | PMN1 |
| | PNM2 | PNM2 | PNM2 | PNM2 | PNM2 | PNM3 | PNM3 | PNM2 | PNM2 | PNM2 |
| | PNM3 | PNM3 | PNM3 | PNM3 | PNM3 | PNM4 | PNM4 | PNM4 | PNM3 | PNM3 |
| | PNM4 | PNM4 | PNM4 | PNM4 | PNM4 | PNM5 | PNM5 | PNM5 | PNM5 | PNM4 |
| | PNM5 | PNM6 | PNM5 | PNM5 | PNM5 | PNM6 | PNM6 | PNM6 | PNM6 | PNM5 |
| | PNM6 | PNM7 | PNM7 | PNM6 | PNM6 | PNM7 | PNM7 | PNM7 | PNM7 | PNM6 |
| | PNM7 | PNM7 | PNM7 | PNM7 | PNM7 | PNM7 | PNM7 | PNM7 | PNM7 | PNM7 |
| F | PNM1 | PMN1 | PMN1 | PMN1 | PNM2 | PMN1 | PMN1 | PMN1 | PMN1 | PMN1 |
| | PNM2 | PNM2 | PNM2 | PNM2 | PNM3 | PNM3 | PNM2 | PNM2 | PNM2 | PNM2 |
| | PNM3 | PNM3 | PNM3 | PNM3 | PNM4 | PNM4 | PNM4 | PNM3 | PNM3 | PNM3 |
| | PNM4 | PNM4 | PNM4 | PNM4 | PNM5 | PNM5 | PNM5 | PNM5 | PNM4 | PNM4 |
| | PNM5 | PNM5 | PNM5 | PNM5 | PNM6 | PNM6 | PNM6 | PNM6 | PNM6 | PNM5 |
| | PNM6 | PNM7 | PNM6 | PNM6 | PNM7 | PNM7 | PNM7 | PNM7 | PNM7 | PNM6 |
| | PNM7 | PNM7 | PNM7 | PNM7 | PNM7 | PNM7 | PNM7 | PNM7 | PNM7 | PNM7 |

LIQUID DISCHARGING APPARATUS AND LIQUID DISCHARGING METHOD

BACKGROUND OF THE INVENTION

1. Field of the Invention

The present invention relates to a liquid discharging apparatus having a head in which a plurality of liquid discharging portions, each having a nozzle, are arranged in a specific direction, and to a liquid discharging method using the head.

2. Description of the Related Art

Ink-jet printers are known as liquid discharging apparatuses. One type of ink-jet printer is a serial printer in which droplets are discharged from a head onto a recording medium while moving the head in the lateral direction of the recording medium, and in which the recording medium is moved in the feeding direction. Another type of ink-jet printer is a line printer having a line head extending along the overall width of the recording medium, in which only the recording medium is moved in a direction perpendicular to the lateral direction thereof, and in which droplets are discharged from the line head onto the recording medium (see, for example, Japanese Unexamined Patent Application Publication No. 2002-36522).

In print heads used in these ink-jet printers, when ink droplets are not discharged from any of the discharging portions for some reason, ink does not adhere to a position on a recording medium corresponding to the discharging portion, and a white stripe appears. This reduces the image quality. In some cases, ink droplets are discharged from a discharging portion in a direction deviating from the allowable range, or the amount of ink discharged from a discharging portion is quite small. These cases also reduce the image quality. In particular, since a line head includes more discharging portions than a serial head, a wider range of variations in ink discharging characteristics occur.

In a serial head, even when there are some variations in ink discharging characteristics among the discharging portions, the variations can be reduced by a method, called "superimposition", for overlapping dots to bridge gaps between previously printed dots.

In contrast, since a line head does not move, it cannot perform overprinting on a prerecorded region. For this reason, variations among the discharging portions remain as in the direction in which the discharging portions are arranged, and result in conspicuous stripes.

Accordingly, in ink-jet printers, measures have been taken so that all the discharging portions of a print head properly discharge ink droplets. In particular, clogging of an ink discharging outlet, for example, due to drying of ink droplets is prevented by maintenance such as cleaning.

However, for example, in thermal ink-jet printers, problems that cannot be overcome by maintenance sometimes occur: for example, a heater for heating and discharging ink breaks, and an ink chamber malfunctions. In these cases, none of the discharging portions can discharge ink droplets. Since a print head having such a discharging portion cannot be repaired, it has been treated as defective.

For example, when it is assumed that the possibility of occurrence of such a defective discharging portion is approximately 1/40,000, one out of two hundred print heads, each having two hundred discharging portions, has a defective discharging portion. In this case, half of the print heads having multiple discharging portions, such as line heads, are defective, for example, when the recording paper is A4-sized and the resolution is 600 dpi because approximately five thousand discharging portions are prepared for one color, that is, approximately twenty thousand discharging portions are prepared for four colors. Therefore, the production yields of print heads are significantly reduced.

SUMMARY OF THE INVENTION

Accordingly, it is an object of the present invention to reduce the occurrence of stripes and to improve print quality by making correction in accordance with variations in discharging characteristics among liquid discharging portions.

In order to overcome the above problems, a first invention provides a liquid discharging method for discharging droplets from a plurality of liquid discharging portions, the method including the steps of discharging droplets from the liquid discharging portions to form an actual pattern, obtaining information about a defective liquid discharging portion having discharging failure by checking the actual pattern for the discharging states of the droplets, and prohibiting the defective liquid discharging portion from discharging, and controlling discharging of ink droplets from a liquid discharging portion near the defective liquid discharging portion.

In such a method, information about a defective liquid discharging portion having discharging failure can be obtained by checking the actual pattern for the discharging states of droplets. The defective liquid discharging portion is prohibited from discharging, and discharging of a liquid discharging portion near the defective liquid discharging portion is controlled, thereby correcting discharging of the discharging portions. This reduces the influence of discharging failure of the defective liquid discharging portion.

A second invention provides a liquid discharging apparatus for forming an image on a recording medium by discharging droplets from a plurality of liquid discharging portions onto the recording medium, the apparatus including a liquid discharging head having the liquid discharging portions, a head driver for controlling the driving of the liquid discharging head, an image processing unit that converts externally input image data into head driving data for driving the liquid discharging head and sends the head driving data to the head driver, and a storage section for storing information about a defective liquid discharging portion, the information being obtained by checking an actual pattern that indicates the discharging states of the droplets from the liquid discharging portions, wherein image formation on the recording medium is corrected by prohibiting the defective liquid discharging portion form discharging, and controlling discharging from a liquid discharging portion near the defective liquid discharging portion according to the information about the defective liquid discharging portion stored in the storage section.

In this case, the actual pattern is checked for the discharging states of droplets, information about the defective liquid discharging portion is stored in the storage section, and discharging of droplets from a liquid discharging portion near the defective liquid discharging portion is controlled while prohibiting the defective liquid discharging portion according to the information of the defective liquid discharging portion from the storage section, thereby correcting image formation on the recording medium. This reduces the influence of discharging failure of the defective liquid discharging portion on the image quality, and enhances the production yield of the liquid discharging apparatus.

A third invention provides a liquid discharging method for discharging droplets from a plurality of liquid discharging portions onto a recording medium while controlling the discharging directions of the droplets, the method including the steps of obtaining information about a defective liquid discharging portion having discharging failure by checking the discharging states of the droplets discharged from the liquid discharging portions, and prohibiting the defective liquid discharging portion from discharging and discharging droplets from a liquid discharging portion different from the defective liquid discharging portion while controlling the discharging direction.

In such a method, information about a defective liquid discharging portion is obtained, the defective liquid discharging portion is prohibited from discharging, and irk droplets are discharged from a liquid discharging portion different from the defective liquid discharging portion while controlling the discharging direction. This reduces the influence of discharging failure of the defective liquid discharging portion.

A fourth invention provides a liquid discharging method for forming dot arrays or dots on a recording medium by discharging droplets from a plurality of liquid discharging portions while controlling the discharging direction and changing the dot diameter by the number of the discharged droplets, the method including the steps of obtaining information about a defective liquid discharging portion having discharging failure by checking the discharging states of the droplets discharged from the liquid discharging portions, and prohibiting the defective liquid discharging portion from discharging and discharging droplets from a liquid discharging portion different from the defective liquid discharging portion while controlling the discharging direction.

In such a method, information about a defective liquid discharging portion is obtained, the defective liquid discharging portion is prohibited from discharging, and ink droplets are discharged from a liquid discharging portion different from the defective liquid discharging portion while controlling the discharging direction. This reduces the influence of discharging failure of the defective liquid discharging portion.

A fifth invention provides a liquid discharging method for forming dot arrays or dots on a recording medium by discharging droplets from a plurality of liquid discharging portions while controlling the discharging direction and changing the dot diameter by the number of the discharged droplets, the method including the steps of obtaining information about a defective liquid discharging portion having discharging failure by checking the discharging states of the droplets discharged from the liquid discharging portions, prohibiting the defective liquid discharging portion from discharging and generating new droplet discharging signals for reducing the influence of discharging failure of the defective liquid discharging portion, and discharging droplets from a liquid discharging portion different from the defective liquid discharging portion while controlling the discharging direction according to the new droplet discharging signals.

In such a method, information about a defective liquid discharging portion is obtained, the defective liquid discharging portion is prohibited from discharging, new droplet discharging signals are generated to reduce the influence of discharging failure of the defective liquid discharging portion, and droplets are discharged from a liquid discharging portion different from the defective liquid discharging portion while controlling the discharging direction according to the new droplet discharging signals in order to change the dot diameter. This reduces the influence of discharging failure of the defective liquid discharging portion.

A sixth invention provides a liquid discharging apparatus for forming dot arrays or dots on a recording medium by discharging droplets from a plurality of liquid discharging portions onto the recording medium while controlling the discharging direction, the apparatus including a liquid discharging head having the liquid discharging portions, a head driver for controlling the driving of the liquid discharging head, a processing unit that converts externally input signals into droplet discharging signals for driving the liquid discharging head and sends the droplet discharging signals to the head driver and a storage section for storing information about a defective liquid discharging portion, the information being obtained by checking the discharging states of the droplets from the liquid discharging portions, wherein the influence of discharging failure of the defective droplet discharging portion is reduced by prohibiting the defective liquid discharging portion from discharging and discharging droplets from a liquid discharging portion different from the defective liquid discharging portion while controlling the discharging direction, according to the information about the defective liquid discharging portion stored in the storage section.

In this case, the discharging states of droplets discharged from the liquid discharging portions are checked, and information about a defective liquid discharging portion is stored in the storage section. According to the information about the defective liquid discharging portion stored in the storage section, the defective liquid discharging portion is prohibited from discharging, and droplets are discharged from a liquid discharging portion different from the defective liquid discharging portion while changing the discharging direction, thereby changing the dot diameter. This removes the influence of discharging failure of the defective liquid discharging portion.

A seventh invention provides a liquid discharging apparatus for forming dot arrays or dots on a recording medium by discharging droplets from a plurality of liquid discharging portions onto the recording medium while controlling the discharging direction and changing the dot diameter by the number of the discharged droplets, the apparatus including a liquid discharging head having the liquid discharging portions, a head driver for controlling the driving of the liquid discharging head, a processing unit that converts externally input signals into droplet discharging signals for driving the liquid discharging head and sends the droplet discharging signals to the head driver, and a storage section for storing information about a defective liquid discharging portion, the information being obtained by checking the discharging states of the droplets discharged from the liquid discharging portions, wherein the influence of discharging failure of the defective droplet discharging portion is reduced by prohibiting the defective liquid discharging portion from discharging and discharging droplets from a liquid discharging portion different from the defective liquid discharging portion while controlling the discharging direction so as to change the dot diameter, according to the information about the defective liquid discharging portion stored in the storage section.

In this case, the discharging states of droplets discharged from the liquid discharging portions are checked, and information about the defective liquid discharging portion is stored in the storage section. According to the information about the defective liquid discharging portion stored in the storage section, the defective liquid discharging portion is prohibited from discharging, and droplets are discharged from a liquid discharging portion different from the defective liquid discharging portion while changing the discharging direction so as to change the dot diameter. This resolves the influence of discharging failure of the defective liquid discharging portion on the formation of dot arrays or dots.

An eighth invention provides a liquid discharging apparatus for forming dot arrays or dots on a recording medium by discharging droplets from a plurality of liquid discharging portions onto the recording medium while controlling the discharging direction, the apparatus including a liquid discharging head having the liquid discharging portions, a head driver for controlling the driving of the liquid discharging head, a processing unit that converts externally input signals into droplet discharging signals for driving the liquid discharging head and sends the droplet discharging signals to the head driver, a storage section for storing information about a defective liquid discharging portion, the information being obtained by checking the discharging states of the droplets discharged from the liquid discharging portions, and a discharging corrector for generating new droplet discharging signals to reduce the influence of discharging failure of the defective discharging portion, wherein the influence of discharging failure of the defective droplet discharging portion is removed by prohibiting the defective liquid discharging portion from discharging according to the information about the defective liquid discharging portion, and discharging droplets from a liquid discharging portion different from the defective liquid discharging portion while controlling the discharging direction, according to the new droplet discharging signals generated by the discharging corrector so as to change the dot diameter.

In this method, information about a defective liquid discharging portion is obtained, and the defective liquid discharging portion is prohibited from discharging. New droplet discharging signals are generated to reduce the influence of discharging failure of the defective liquid discharging portion, and droplets are discharged from a liquid discharging portion different from the defective liquid discharging portion while controlling the discharging direction according to the new droplet discharging signals so as to change the dot diameter. This allows dot arrays or dots to be formed without any influence of the discharging failure of the defective liquid discharging portion.

Further objects, features and advantages of the present invention will become apparent from the following description of the preferred embodiments with reference to the attached drawings.

BRIEF DESCRIPTION OF THE DRAWINGS

FIG. 9 is a part of a print correction table that lists corrected print information (image formation signals) generated to reduce the influence of discharging failure of the defective discharging portion;

FIG. 10 is the other part of the print correction table that lists corrected print information (image formation signals) generated to reduce the influence of discharging failure of the defective discharging portion;

FIG. 22 is a table showing the relationship between dots formed by PNM, and discharging portions for discharging ink droplets to form the dots;

FIG. 23 is a correction table that lists new droplet discharging signals generated to reduce the influence of discharging failure of the a discharging portion;

DESCRIPTION OF THE PREFERRED EMBODIMENTS

Embodiments of the present invention will be described in detail below with reference to the attached drawings.

Figure 1:
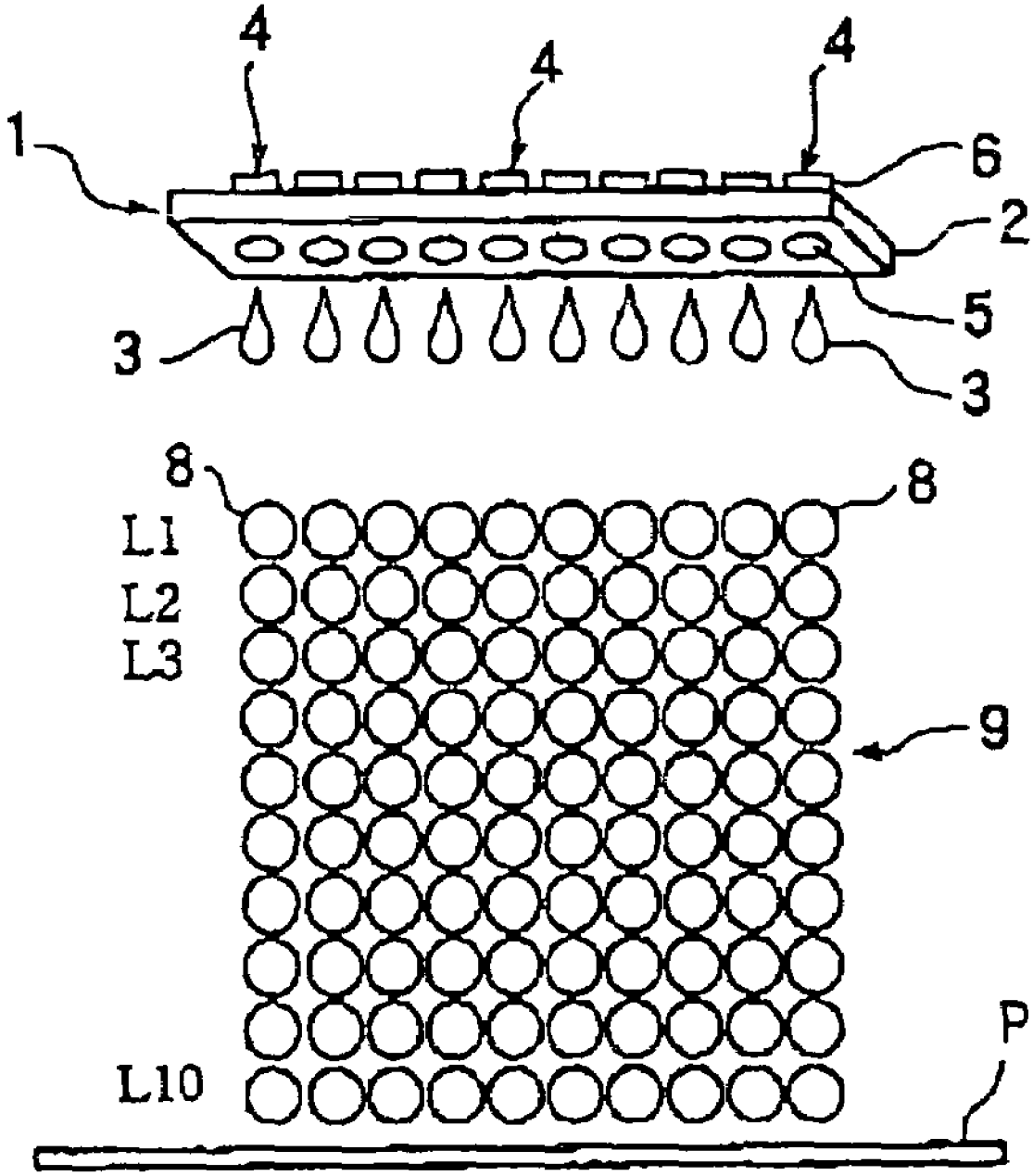
FIG. 1 is a general view showing an image forming method according to an embodiment of the present invention.

FIG. 1 is a general view showing a liquid discharging method according to an embodiment corresponding to a first invention of the present invention. In the liquid discharging method of this embodiment, an image is formed on a recording medium by discharging liquid (for example, ink droplets) from a plurality of liquid discharging portions (hereinafter, simply referred to "discharging portions") provided in a liquid discharging head (hereinafter, simply referred to as a "print head") onto the recording medium. In the following description, ink droplets are used as the liquid. Referring to FIG. 1, a print head 1 includes a sheet-shaped nozzle member 2, and a plurality of discharging portions 4 provided in the nozzle member 2 to discharge ink droplets 3. Each of the discharging portions 4 includes a discharging outlet 5 formed in the nozzle member 2, and a heating element 6 serving as a driving element for heating and discharging ink in an ink chamber (not shown). In such a state, ink droplets 3 are discharged from the discharging portions 4 of the print head 1 onto a recording medium P, thereby forming an image on the recording medium P.

The print head 1 is a line head, and adopts a so-called PNM (Pulse Number Modulation) method that changes the diameter and density of printed dots by the number of ink droplets 3 discharged from the discharging portions 4. The print head 1 includes ink head portions for four colors, such as yellow Y, magenta M, cyan C, and black K, and is disposed so that the discharging outlets 5 for discharging ink droplets 3 point downward.

For plain explanation, a description will be given of, for example, a case in which yellow, magenta, and black inks are not used, but only cyan ink is used. A maximum of eight droplets are discharged, and five or less droplets are normally discharged to print one dot for each color. The number of droplets for one cyan dot can be changed from zero to eight by the PNM method, as described above. The amount of ink to be discharged is set at, for example, 3.5 pl.

Figure 2A:
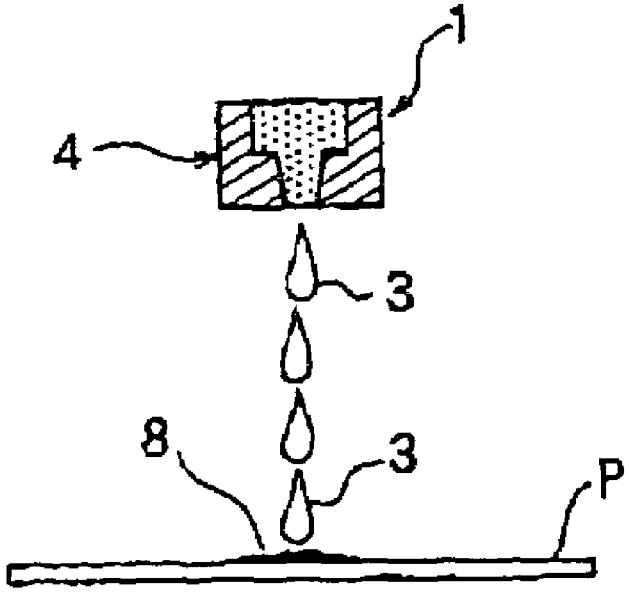
FIGS. 2A and 2B are explanatory views showing a state in which an image is formed on a recording medium by discharging ink droplets from a discharging portion of a print head onto the recording medium.
Figure 2B:
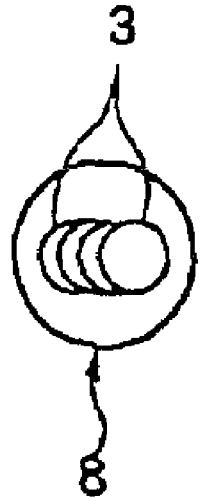

In such a state, for example, when ink droplets 3 are discharged from the discharging portions 4 of the print head 1 onto printing paper serving as a recording medium P, as shown in FIG. 2A, the size of a printed dot 8 gradually increases as the number of ink droplets 3 increases, as shown in FIG. 2B.

Figure 3:
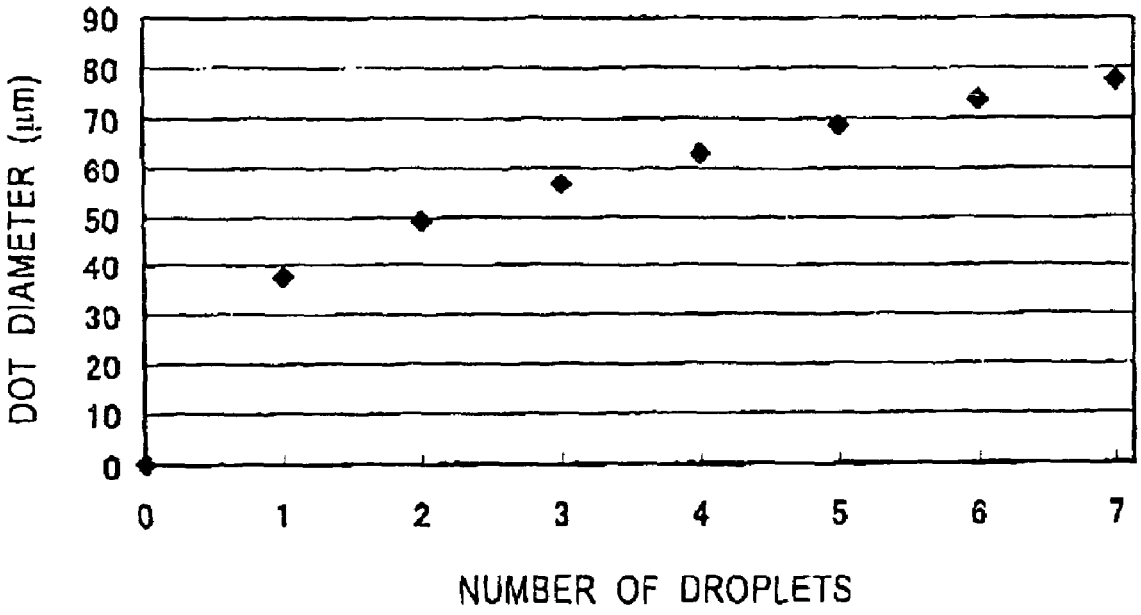
FIG. 3 is a graph showing the relationship between the number of ink droplets discharged from the discharging portions to print an image, and the dot diameter.

FIG. 3 shows the relationship between the number of droplets and the dot diameter. That is, as the number of droplets increases from one to eight, the dot diameter increases from approximately 38 μm to approximately 82 μm. In a case in which four ink droplets are discharged, as shown in FIG. 2A, the dot diameter is approximately 63 μm.

Figure 4:
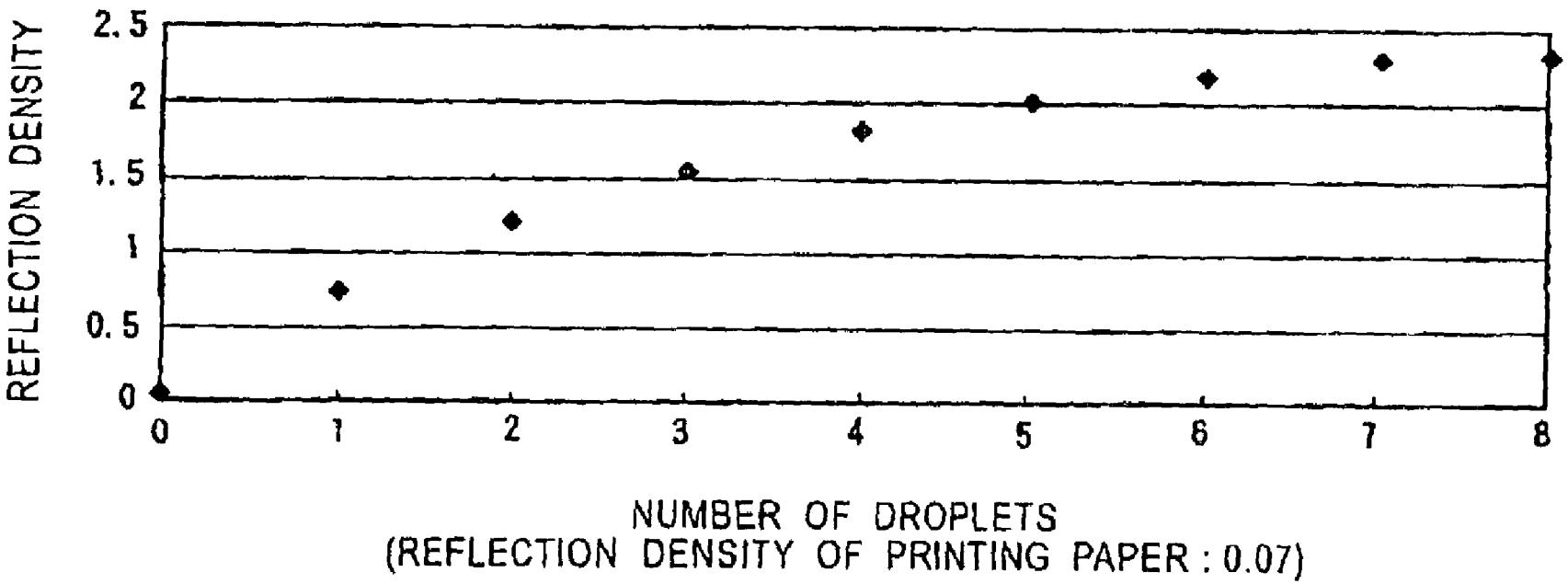
FIG. 4 is a graph showing the relationship between the reflection density of a surface of a recording medium on which dots are solidly printed at a density of, for example, 600 dpi by discharging the ink droplets from the discharging portions, and the number of droplets.

FIG. 4 shows the relationship between the number of droplets and the reflection density of a surface of the recording medium P on which a dot 8 is solidly printed at a density of, for example, 600 dpi. In this case, when it is assumed that the reflection density of printing paper as the recording medium P is, for example, 0.07, the reflection density increases from approximately 0.75 to approximately 2.4 as the number of droplets increases from one to eight. When four ink droplets are discharged, as shown in FIG. 2A, the reflection density is approximately 1.8.

In such a liquid discharging method in which an image is formed on a recording medium P by discharging ink droplets 3 from the discharging portions 4 of the printed head 1 onto the recording medium P, an actual pattern is first formed which indicates the discharging states of ink droplets 3 from all the discharging portions 4 corresponding to an image forming region on the recording medium P. That is, ink droplets 3 are discharged using the above-described PNM method to print an actual pattern on the recording medium P by the first dots 8. In this case, when ink droplets 3 are normally discharged from all the discharging portions 4, an actual pattern 9 is formed in which, for example, dots 8 are solidly printed from the first line L1 to the tenth line L10 on the recording medium P by the ink droplets 3, as shown in FIG. 1.

Figure 5:
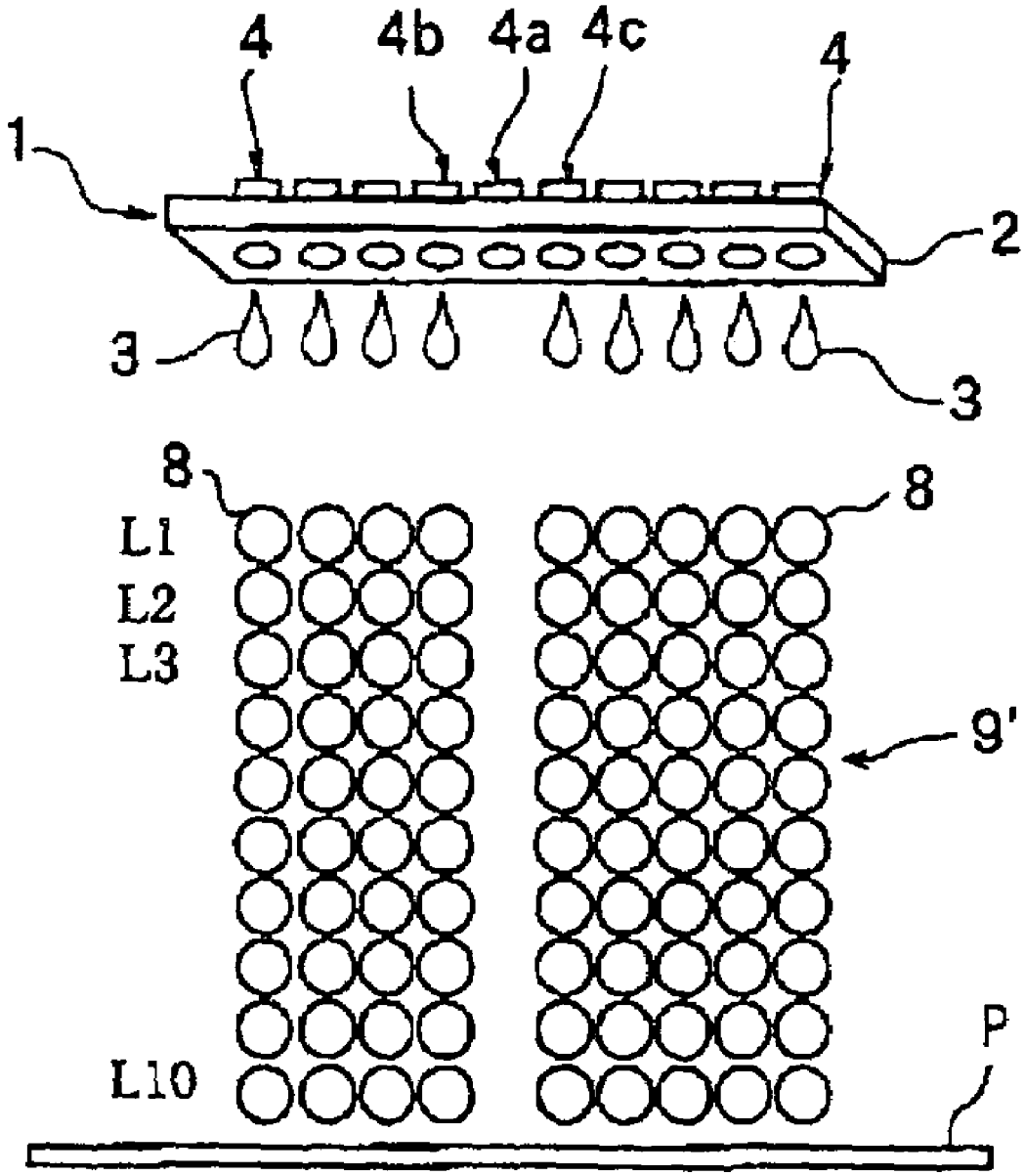
FIG. 5 is an explanatory view showing an actual pattern that indicates the discharging states of ink droplets when an ink droplet is not discharged from any of the discharging portions in the print head.

In contrast, when one discharging portion 4*a* in the print head 4 cannot properly discharge ink droplets 3, as shown in FIG. 5, ink does not adhere at all or insufficiently adheres to a portion of the recording medium P corresponding to the discharging portion 4*a*. Consequently, an actual pattern 9' is printed in which a white stripe or a lightly colored portion is formed from the first line L1 to the tenth line L10. FIG. 5 shows a case in which no ink droplet 3 is discharged from the defective discharging portion 4*a* (undischarged state).

By checking the discharging states of ink droplets 3 indicated by the actual patterns 9 and 9' thus obtained, information about the defective discharging portion 4*a* is obtained. That is, on the basis of the actual pattern 9 shown in FIG. 1, it is determined that all the discharging portions 4 can normally work. In contrast, on the basis of the actual pattern 91 shown in FIG. 5, it is determined that one discharging portion 4*a* is defective, and print information, such as the position of the discharging portion 4*a*, the amount of ink discharged therefrom, and the number of discharging shots, is obtained. The obtained print information about the defective discharging portion 4*a* is stored in a storage section provided inside the print head 1 or inside an image processing unit 11 (FIG. 11) which will be described later, or is stored in a storage section provided inside an external control unit such as a host computer. The information may be stored in storage sections provided in some of the print head 1, the image processing unit 11, and the external processing unit.

Figure 6:
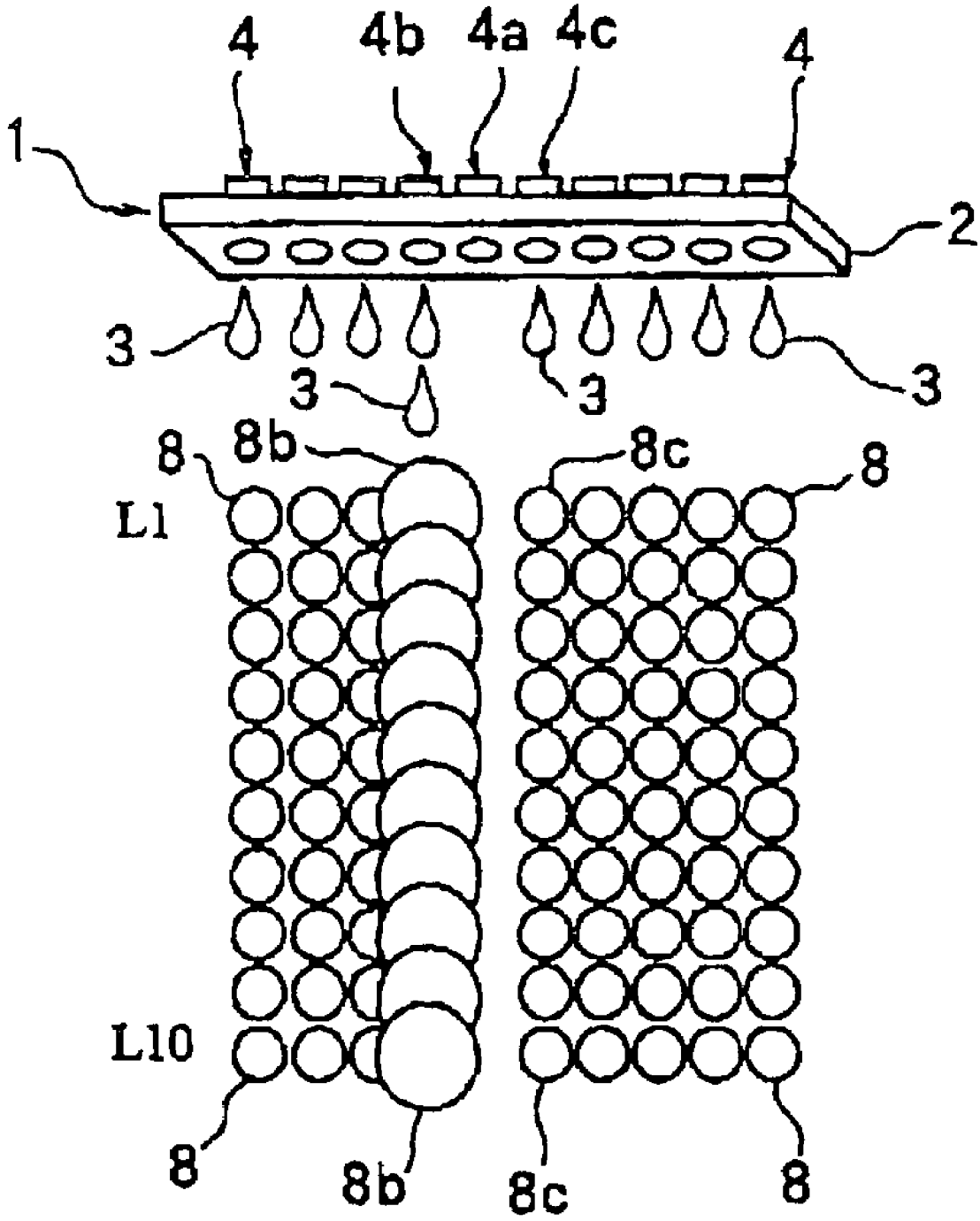
FIG. 6 is an explanatory view showing a state in which image formation is corrected by increasing the discharging amount of ink from a discharging portion on one side of the defective discharging portion shown in FIG. 5, or the number of discharging shots thereby.

According to the print information, the defective discharging portion 4*a* is prohibited from discharging an ink droplet 3, and discharging of ink droplets 3 from discharging portions near the defective discharging portion 4*a*, for example, discharging portions 4*b* and 4*c* on both sides of the defective discharging portion 4*a*, is controlled. For example, the amount of ink discharged from the discharging portion 4*b* (or 4*c*) next to the defective discharging portion 4*a*, or the number of discharging shots thereby is increased, as shown in FIG. 6. In this case, print information about the discharging portion 4*b* (or 4*c*) is changed in accordance with original print information about the defective discharging portion 4*a*. That is, new image forming signals are generated on the basis of original image forming signals for the defective discharging portion 4*a* and the discharging portions 4*b* and 4*c* on both sides thereof to reduce the influence of the discharging failure, and ink droplets 3 are discharged in response to the image forming signals.

More specifically, the print information about the defective discharging portion 4*a* is changed to indicate that the discharging portion 4*a* is prohibited from discharging, and the print information about the next discharging portion 4*b* (or 4*c*) is changed to indicate that the number of ink droplets 3 to be discharged therefrom is increased so as to form dots having a diameter larger than the diameter of dots 8 formed according to the original print information about the defective discharging portion 4*a*. Consequently, as shown in FIG. 6, an increased number of ink droplets 3 are discharged from the discharging portion 4*b* next to the defective discharging portion 4*a*, so that dots 8*b* having a larger diameter are continuously printed on one side of a white stripe formed on the recording medium P corresponding to the defective discharging portion 4*a* from the first line L1 to the tenth line L10. Extensions of the larger dots 8*b* cover one side of the white stripe shown in FIG. 5, and make the white stripe less conspicuous, thereby correcting image formation on the recording medium P. Therefore, the influence of discharging failure of the defective discharging portion 4*a* on the image quality can be reduced, the print head 1 can operate even when any of the discharging portions 4 is defective, and the production yield of the print head 1 can be increased.

Figure 7:
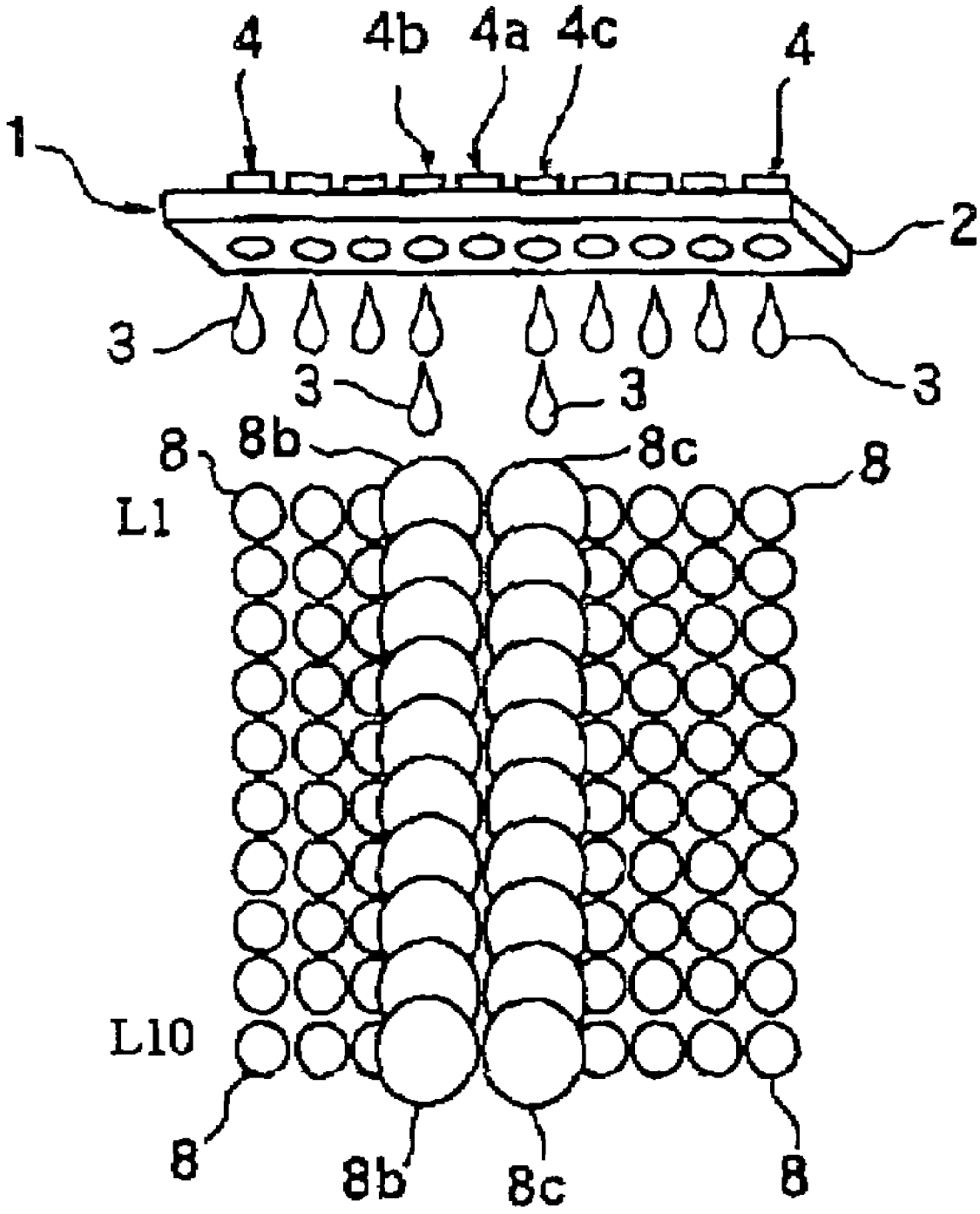
FIG. 7 is an explanatory view showing a state in which image formation is corrected by increasing the discharging amount of ink from discharging portions on both sides of the defective discharging portion shown in FIG. 5, or the number of discharging shots thereby.

Alternatively, the amount of ink to be discharged from the discharging portions 4*b* and 4*c* on both sides of the defective discharging portion 4*a* or the number of discharging shots thereby may be increased, as shown in FIG. 7. In this case, printing is performed while print information about the discharging portions 4*b* and 4*c* is changed on the basis of the original print information about the defective discharging portion 4*a*.

More specifically, print information about the next discharging portions 4*b* and 4*c* is changed to indicate that the number of ink droplets 3 to be discharged therefrom is increased so as to form dots having a diameter larger than the diameter of dots 8 formed according to the original print information about the defective discharging portion 4*a*. Consequently, as shown in FIG. 7, an increased number of ink droplets 3 are discharged from the discharging portions 4*b* and 4*c* next to the defective discharging portion 4*a*, so that dots Bb and 8*c* having a larger diameter are continuously printed on both sides of a white stripe on the recording medium P corresponding to the defective discharging portion 4*a* from the first line L1 to the tenth line L10. Extensions of the larger dots 8*b* and 8*c* cover both sides of the white stripe shown in FIG. 5, and make the white stripe less conspicuous. Thus, image formation on the recording medium P is corrected, and the influence of discharging failure of the defective discharging portion 4*a* on the image quality can be reduced.

Figure 8:
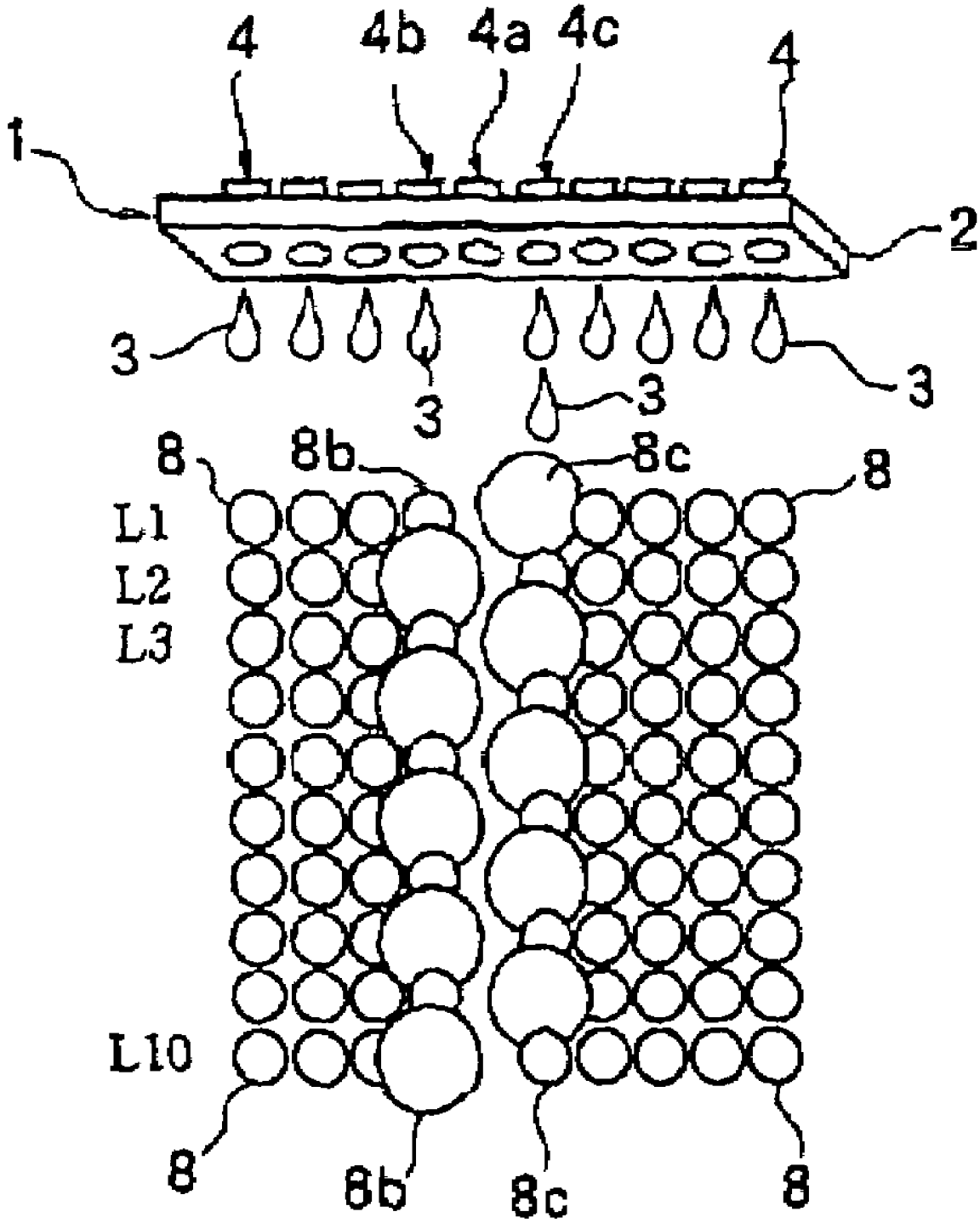
FIG. 8 is an explanatory view showing a state in which image formation is corrected by alternately increasing the discharging amount of ink from discharging portions on both sides of the defective discharging portion shown in FIG. 5 every time one line is printed, or the number of discharging shots thereby.

Alternatively, as shown in FIG. 8, the amount of ink to be discharged from the discharging portions 4*b* and 4*c* on both sides of the defective discharging portion 4*a*, or the number of discharging shots thereby may be alternately increased in each line of an image to be formed. In this case, printing is performed while print information about the discharging portions 4*b* and 4*c* is changed on the basis of the original print information about the defective discharging portion 4*a*.

More specifically, print information about the next discharging portions 4*b* and 4*c* is changed to indicate that the number of ink droplets to be discharged therefrom is alternately increased so as to form dots having a diameter larger than the diameter of dots 8 formed according to the original print information about the defective discharging portion 4*a*. As shown in FIG. 8, in the first line L1, dots 8*b* having a normal diameter are printed by one of the discharging portions 4*b*, and dots 8*c* having a diameter larger than the normal diameter are printed by the other discharging portion 4*c*. In the second line L2, dots 8*b* having a diameter larger than the normal diameter are printed by the discharging portion 4*b*, and dots 8*c* having the normal diameter are printed by the discharging portion 4*c*. In the third line L3, dots 8*b* having the normal diameter are printed by the discharging portion 4*b*, and dots 8*c* having a diameter larger than the normal diameter are printed by the discharging portion 4*c*, in a manner similar to that in the first line L1. In the tenth line L10, dots 8*b* having a diameter larger than the normal diameter are printed by the discharging portion 4*b*, and dots 8*c* having the normal diameter are printed by the discharging portion 4*c*.

In this way, dots 8*b* and Bc having a larger diameter are alternately printed from the first line L1 to the tenth line L10 on both sides of a white stripe formed on the recording medium P corresponding to the defective discharging portion 4*a*. Alternately formed extensions of the dots 8*b* and 8*c* alternately cover both sides of the white stripe shown in FIG. 5, and make the white stripe substantially inconspicuous. As a result, image formation on the recording medium P is corrected, and the influence of discharging failure of the defective discharging portion 4*a* on the image quality can be reduced.

The above-described correction of image formation on the recording medium P is generally expressed as follows. Herein, $A_n$ represents original print information about the defective discharging portion 4*a*, and $B_n$ represents corrected print information thereabout. $A_{n-1}$ represents original print information about the left-side discharging portion 4*b*, and $B_{n-1}$ represents corrected print information thereabout. $A_{+1}$ represents original print information about the right-side discharging portion 4*c*, and $B_{n+1}$ represents corrected print information thereabout.

When correction is made to increase the amount of ink to be discharged from the discharging portion 4*b* on the left side of the defective discharging portion 4*a* shown in FIG. 6, or the number of discharging shots therefrom, corrected print information is expressed as follows:

| | |
|---|---|
| defective discharging portion 4a | $B_n = 0$ (not discharged) |
| left discharging portion 4b | $B_{n-1} = (A_{n-1}) + A_n$ |
| right discharging portion 4c | $B_{n+1} = A_{n+1}$ |

When correction is made to increase the amount of ink to be discharged from the discharging portion 4*c* on the right side of the defective discharging portion 4*a* shown in FIG. 6, or the number of discharging shots therefrom, corrected print information is expressed as follows:

| | |
|---|---|
| defective discharging portion 4a | $B_n = 0$ (not discharged) |
| left discharging portion 4b | $B_{n-1} = A_{n-1}$ |
| right discharging portion 4c | $B_{n+1} = (A_{n+1}) + A_n$ |

When correction is made to increase the amount of ink to be discharged from the discharging portions 4*b* and 4*c* on both sides of the defective discharging portion 4*a*, or the number of discharging shots therefrom, as shown in FIG. 7, corrected print information is expressed as follows:

| | |
|---|---|
| defective discharging portion 4a | $B_n = 0$ (not discharged) |
| left discharging portion 4b | $B_{n-1} = (A_{n-1}) + A_n$ |
| right discharging portion 4c | $B_{n+1} = (A_{n+1}) + A_n$ |

When correction is made to alternately increase the amount of ink to be discharged from the discharging portions 4*b* and 4*c* on both sides of the defective discharging portion 4*a*, or the number of discharging shots in each line, as shown in FIG. 8, corrected print information is expressed as follows:

| | |
|---|---|
| (1) Odd line | |
| defective discharging portion 4a | $B_n = 0$ (not discharged) |
| left discharging portion 4b | $B_{n-1} = A_{n-1}$ |
| right discharging portion 4c | $B_{n+1} = (A_{n+1}) + A_n$ |
| (2) Even line | |
| defective discharging portion 4a | $B_n = 0$ (not discharged) |
| left discharging portion 4b | $B_{n-1} = (A_{n-1}) + A_n$ |
| right discharging portion 4c | $B_{n+1} = A_{n+1}$ |

Although not shown, when the amount of ink to be discharged from the discharging portions 4*b* and 4*c* on both sides of the defective discharging portion 4*a*, or the number of discharging shots therefrom is increased according to a given function, corrected print information is expressed as follows:

| | |
|---|---|
| defective discharging portion 4a | $B_n = 0$ (not discharged) |
| left discharging portion 4b | $B_{n-1} = (A_{n-1}) + X(A_n)$ |
| right discharging portion 4c | $B_{n+1} = (A_{n+1}) + Y(A_n)$ |

where $X(A_n)$ and $Y(A_n)$ are functions of $A_n$.

In any of the above-described corrections, corrected print information (image formation signals) may be differently corrected depending on, for example, characteristics of ink droplets, the type of a recording medium, the image formation mode, the ink color, the size of one ink droplet, or the resolution. For example, in a case in which black ink K having a surface tension higher than those of other inks is used to improve character quality, it is unapt to spread wide on printing paper. Therefore, in order to achieve a better result, image formation should be corrected in consideration of the way of spreading of the ink.

The above-described corrected print information (image formation signals) may be summarized beforehand in a table, as shown in, for example, FIGS. 9 and 10. FIGS. 9 and 10 show two sections of one print correction table. In the table, corrected print information $B_{n-1}$, $B_n$, and $B_{n+1}$ about an odd line and corrected print information $B_{n-1}$, $B_n$, and $B_{n+1}$ about an even line are shown corresponding to original print information $A_{n-1}$, $A_n$, and $A_{n+1}$ about a certain line. That is, printing of a line is corrected by two lines corresponding thereto. In the table, the number of ink droplets 3 to be discharged from the discharging portions 4 are shown by, for example, 0 to 8.

While discharging failure means that not ink droplets 3 are discharged from any of the discharging portions 4 of the print head 1 in the above description, the present invention is not limited to such a case, and is also applicable to a case in which ink droplets 3 discharged from any discharging portion 4 land outside the allowable region on a recording medium P, or to a case in which the amount of ink discharged from any discharging portion 4 is outside the allowable range.

In a case in which ink droplets 3 discharged from a defective discharging portion 4*a* land outside the allowable region on a recording medium P, they deviate from a predetermined direction, and a white stripe is formed on the recording medium P corresponding to the defective discharging portion 4*a*, in a manner similar to that in FIG. 5. In a case in which the amount of ink discharged from a defective discharging portion 4*a* is outside the allowable range, it is less than a predetermined amount, and a lightly colored portion is formed on the recording medium P corresponding to the defective discharging portion 4*a* shown in FIG. 5.

While the amount of ink applied on the recording paper P is controlled by PNM in the above description, in a print head having discharging portions each of which can change the discharging amount of ink, the discharging amount of ink itself may be controlled. Alternatively, the amount of ink may be controlled by a combination of PNM and the method of changing the discharging amount.

Figure 11:
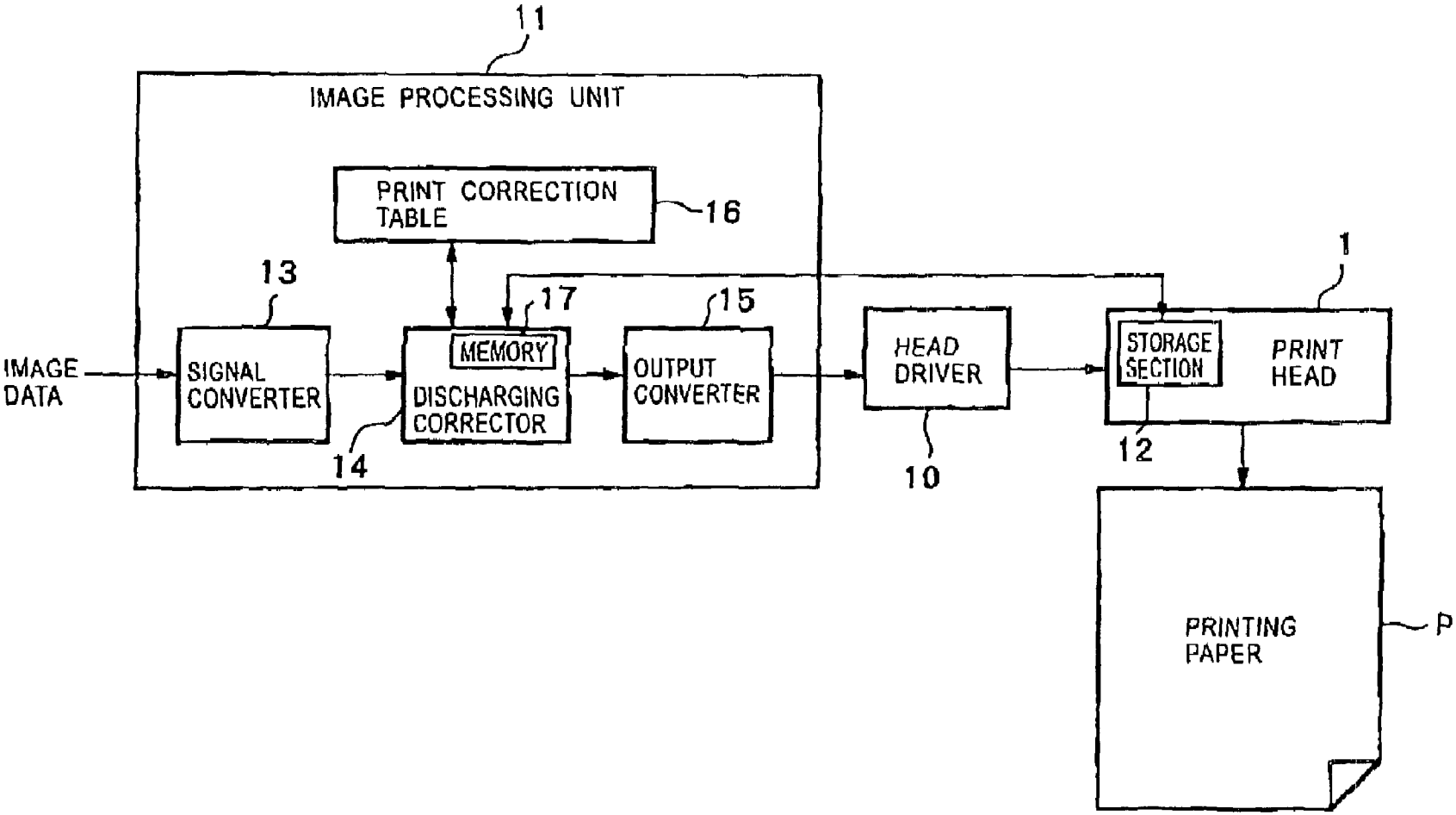
FIG. 11 is a block diagram of an image forming apparatus relating to the image forming method of the present invention.

A liquid discharging apparatus as an invention (a second invention of the present invention) relating to the above-described liquid discharging method will now be described with reference to FIG. 11. An image forming apparatus serving as the liquid discharging apparatus is, for example, an ink-jet printer, and forms an image on a recording medium by discharging ink droplets from a plurality of discharging portions of a print head onto the recording medium. The image forming apparatus includes a print head 1, a head driver 10, and an image processing unit 11, as shown in FIG. 11.

The print head 1 actually discharges ink droplets onto printing paper serving as a recording medium P to print characters and images thereon, and has a plurality of discharging portions 4 provided in a sheet-shaped nozzle member 2 to discharge ink droplets 3, as shown in FIG. 1. Each of the discharging portions 4 includes a discharging outlet 5 formed in the nozzle member 2, and a heating element 6 serving as a driving element for heating and discharging ink in an ink chamber (not shown). A storage section 12 is provided inside the print head 1 to check the discharging states of ink droplets 3 on the basis of actual patterns 9 and 9', which indicate the discharging states of ink droplets 3 from all the discharging portions 4 corresponding to an image forming region of the recording medium P, and to store information about a defective discharging portion as described with reference to FIGS. 1 and 5.

The head driver 10 controls the driving of the print head 1 by fetching driving signals from the image processing unit 11, which will be described later, and supplying ON and OFF signals for driving control to the print head 1.

The image processing unit 11 processes externally input image data, converts the data into head-driving data for driving the print head 1, and sends the converted data to the head driver 10. The image processing unit 11 includes a signal converter 13, a discharging corrector 14, an output converter 15, and a print correction table 16.

The signal converter 13 receives externally input image data, and converts the image data into multilevel data having a number of colors and a number of levels in accordance with the performance of the overall liquid discharging apparatus by performing, as necessary, data decompression, rasterizing, scaling, color conversion, limitation of the amount of ink, gamma correction, or tone correction such as error diffusion, on the basis of print information such as a selected image formation mode or the type of a recording medium P (printing paper). The print information, such as the image formation mode and the type of printing paper, is sometimes added to a header of the input image data, and is sometimes directly supplied from an input panel (not shown) of the apparatus. In a case in which new print information is not given, the same information as that in the previous print operation, or default information may be used.

The discharging corrector 14 inputs the multilevel data converted by the signal converter 13, and corrects the data so that the influence of discharging failure of a defective discharging portion 4*a* (see FIG. 5) hardly appears on the recording medium P, on the basis of information about the defective discharging portion 4*a* read from the storage section 12 in the print head 1 (e.g., the position of the defective discharging portion 4*a* and the type of discharging failure) and print information (image formation signals) read from the print correction table 16 which will be described later. A memory 17 is provided in the discharging corrector 14 to store discharging information read from the storage section 12. This allows the discharging information to be read from the storage section 12 and stored in the memory 17 when the print head 1 is mounted or the power is turned on. Therefore, the discharging information does not need to be read from the storage section 12 in every operation, and can be normally read from the memory 17.

The output converter 15 functions as an output converting means for converting multilevel data corrected by the discharging corrector 14 into driving signals for the head driver 10. The output converter 15 converts the multilevel data into ON and OFF signals for actually driving the head driver 10.

The print correction table 16 lists and stores new image formation signals corrected to reduce the influence of discharging failure on the basis of original image formation signals for the defective discharging portion 4*a* and the discharging portions 4*b* and 4*c* on both sides thereof (see FIG. 5), as described with reference to FIGS. 9 and 10.

The liquid discharging apparatus having such a configuration operates in a manner similar to that in the liquid discharging method described with reference to FIGS. 1 and 5 to 8. That is, first, the print head 1 is driven under the control of the head driver 10 shown in FIG. 11, and an actual pattern 9 or 9' that indicates the discharging states of ink droplets 3 from all the discharging portions 4 in the print head 1 corresponding to an image forming region on a recording medium P is printed on the recording medium P.

When ink droplets 3 are normally discharged from all the discharging portions 4, an actual pattern 9 is printed on the recording medium P, for example, in which pattern dots 8 are solidly formed by ink droplets 3 from the first line L1 to the tenth line L10, as shown in FIG. 1. In contrast, when any of the discharging portions 4*a* is defective, an actual pattern 9' is printed on the recording medium P, in which ink does not adhere at all or adheres insufficiently corresponding to the defective discharging portion 4*a*, and a white stripe or a lightly colored portion is formed from the first line L1 to the tenth line L10, as shown in FIG. 5. FIG. 5 shows a case in which no ink droplet 3 is discharged from the defective discharging portion 4*a* (undischarged).

Then, the discharging states of ink droplets 3 are checked on the basis of the printed actual pattern 9', and information about the defective discharging portion 4*a* is stored in the storage section 12 in the print head 1 shown in FIG. 11. The information includes, for example, print information such as the position of the defective discharging portion 4*a*, the discharging amount of ink, and the number of discharging shots. The information is recorded in, for example, shipping inspections.

During actual printing on the recording medium P, the discharging corrector 14 in the image processing unit 11 shown in FIG. 11 reads out the information about the defective discharging portion 4*a* from the storage section 12 in the print head 1, and prohibits the defective discharging portion 4*a* from discharging ink droplets 3. Subsequently, on the basis of the information about the defective discharging portion 4*a* and corrected print information (image formation signals) read from the print correction table 16, the discharging corrector 14 controls the discharging of ink droplets 3 from the discharging portions 4*b* and 4*c* near the defective discharging portion 4*a* so that the influence of discharging failure of the defective discharging portion 4*a* hardly appears on the recording medium P.

In this state, the corrected print information is converted into driving signals by the output converter 15, and is sent to the head driver 10. The head driver 10 supplies the input driving signals to the print head 1 to control an actual printing operation on the recording medium P. Consequently, discharging of ink droplets 3 from the discharging portions 4 in the print head 1 is controlled, as shown in, for example, FIG. 6, 7, or 8, and image formation on the recording medium P is corrected. Therefore, the influence of discharging failure of the defective discharging portion 4*a* on the image quality can be reduced, and the print head 1 is allowed to be used even when any of the discharging portions 4 is defective. As a result, the production yield of the print head 1 can be enhanced.

While the storage section 12 is provided inside the print head 1 in FIG. 11, it may be provided inside the image processing unit 11. Alternatively, the storage section 12 may be provided inside an external control unit such as a host computer, or may be provided inside some or all of the print head 1, the image processing unit 11, and the external control unit.

A specific example of the above-described liquid discharging apparatus, for example, an ink-jet printer will now be described with reference to FIG. 12 as a partly cutaway perspective view and FIG. 13 as a sectional side view. An ink-jet printer 20 of this example is provided with a line head 22 that has unshown heating elements (reference numeral 6 in FIG. 1) as driving elements for discharging ink droplets (reference numeral 3 in FIG. 1). The recording range of the ink-jet printer 20 is substantially equal to the width of sheets of paper 21. The ink-jet printer 20 adopts a so-called PNM (Pulse Number Modulation) method for changing the diameter and density of dots (reference numeral 8 in FIG. 2) by the number of ink droplets.

Figure 12:
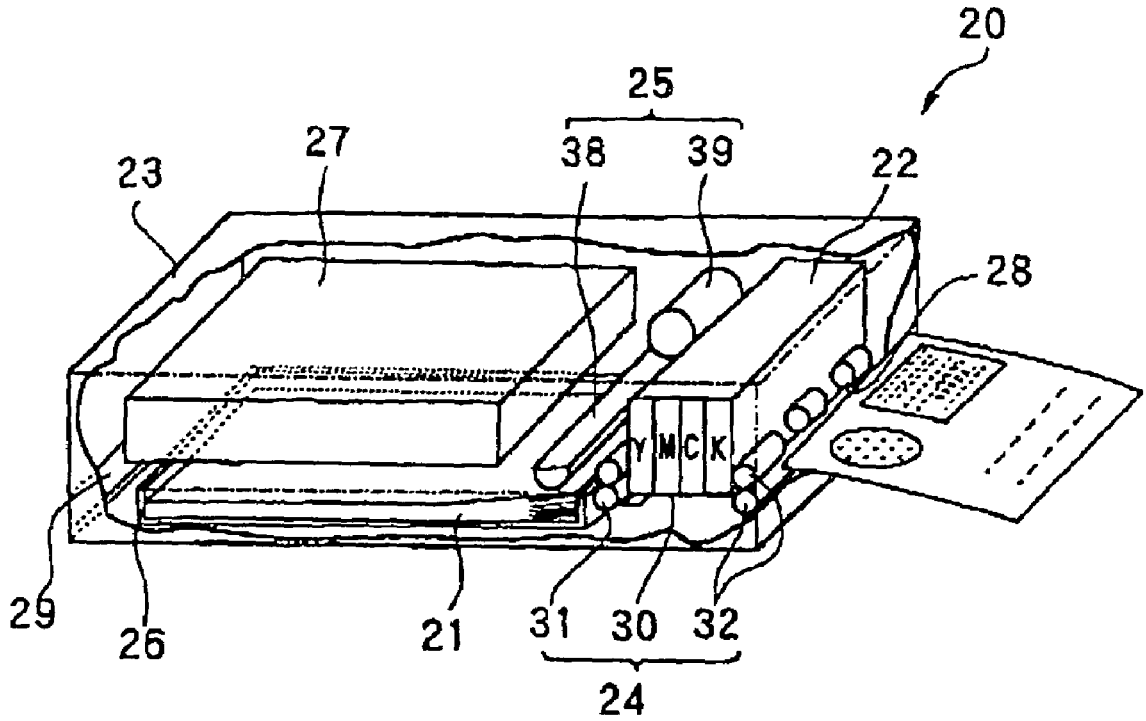
FIG. 12 is a partly cutaway perspective view showing a specific example of an ink-jet printer serving as the image forming apparatus.
Figure 13:
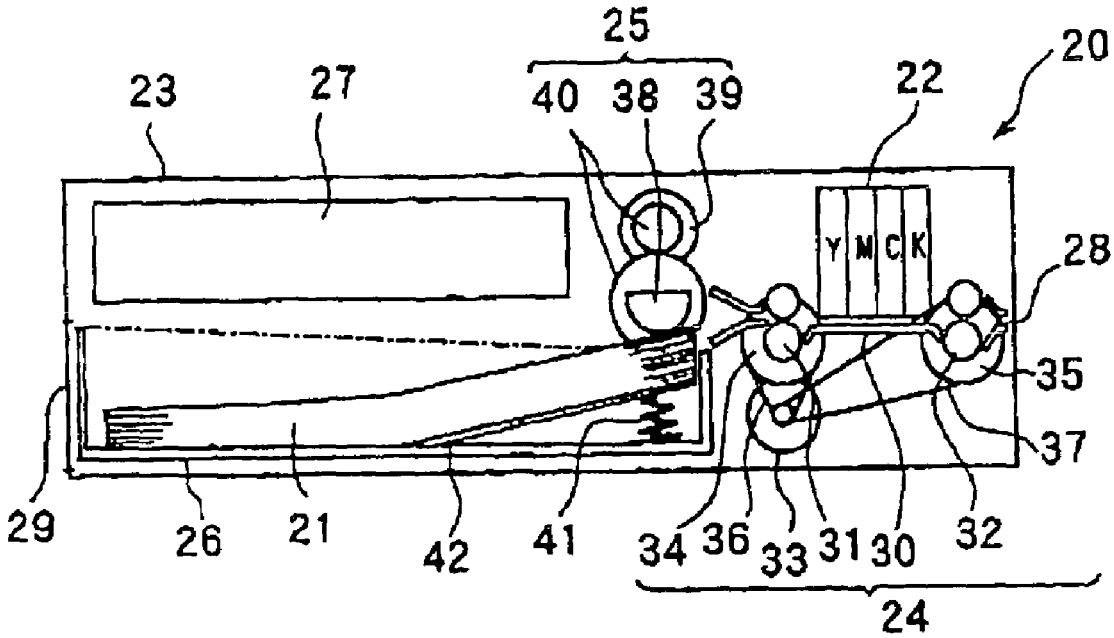
FIG. 13 is a sectional side view of the ink-jet printer.

As shown in FIGS. 12 and 13, the ink-jet printer 20 includes, in a housing 23, the line head 22, a paper feeding section 24, a paper delivery section 25, a paper tray 26, an electric circuit section 27, and so on. The housing 23 is shaped like a rectangular parallelepiped. A paper ejection slot 28 for sheets of paper 21 is provided in one end face of the housing 23, and a tray loading opening 29 for the paper tray 26 is provided in the other end face thereof.

The line head 22 includes head sections for four colors, yellow Y, magenta M, cyan C, and black K, and is disposed in the upper part of an end portion of The housing 23 adjacent to the paper ejection slot 28 so that discharging outlets (reference numeral 5 in FIG. 1) for discharging ink droplets face downward. That is, as described above, the line head 22 is constructed by four elongated ink discharging means for Y, M, C, and K that are arranged in the feeding direction of the sheets of paper 21.

The paper feeding section 24 includes a feeding guide 30, feeding rollers 31 and 32, a feeding motor 33, pulleys 34 and 35, and belts 36 and 37, and is disposed in the lower part of the end portion of the housing 23 adjacent to the paper ejection slot 28. The feeding guide 30 is shaped like a flat plate, and is disposed below the line head 22 with a predetermined space therebetween. Each of the feeding rollers 31 and 32 is composed of a pair of upper and lower rollers in contact with each other, ard are disposed on both sides of the feeding guide 30, that is, on the sides of the tray loading opening 29 and the paper ejection slot 28. The feeding motor 33 is disposed below the feeding guide 30, and is linked to the feeding rollers 31 and 32 through the pulleys 34 and 35 and the belts 36 and 37.

The paper delivery section 25 includes a delivery roller 38, a delivery motor 39, and gears 40, and is disposed on a side of the paper feeding section 24 close to the tray loading opening 29. The delivery roller 38 is substantially semicylindrical, and is disposed adjacent to the feeding roller 31 on the side of the tray loading opening 29. The delivery motor 39 is disposed above the delivery roller 38, and is linked to the delivery roller 38 through the gears 40.

The paper tray 26 is shaped like a box that can accommodate, for example, a plurality of stacked A4-sized sheets of paper 21. A paper support 42 is supported by a spring 41 at one end of the bottom face of the paper tray 26, and extends from below the delivery section 25 toward the tray loading opening 29. The electric circuit section 27 is disposed above the paper tray 26 to control the driving of the components.

The use and basic operation of the ink-jet printer 20 having such a configuration will be described briefly. A user draws the paper tray 26 from the tray loading opening 29, puts a predetermined number of sheets of paper 21 into the paper tray 26, and then pushes the paper tray 26. Then, the paper support 42 raises and presses one end of the paper 21 against the delivery roller 38 by the action of the spring 41. This brings about a print standby state.

When a print start signal is given, the delivery roller 38 is rotated by the delivery motor 39 to deliver one sheet 21 from the paper tray 26 to the feeding roller 31. Subsequently, the feeding rollers 31 and 32 are rotated by the feeding motor 33, and the feeding roller 31 feeds the delivered sheet 21 to the feeding guide 30. Then, the line head 22 operates at a predetermined timing according to print data, and discharges ink droplets from discharging outlets onto the sheet 21 to print characters and images formed by dots. Next, the feeding roller 32 ejects the fed sheet 21 from the paper ejection slot 28.

The ink-jet printer 20 having such a configuration operates in a manner similar to that in the image forming method that has been described with reference to FIGS. 1 and 5 to 8.

Third, fourth, and fifth inventions will now be described.

Figure 14:
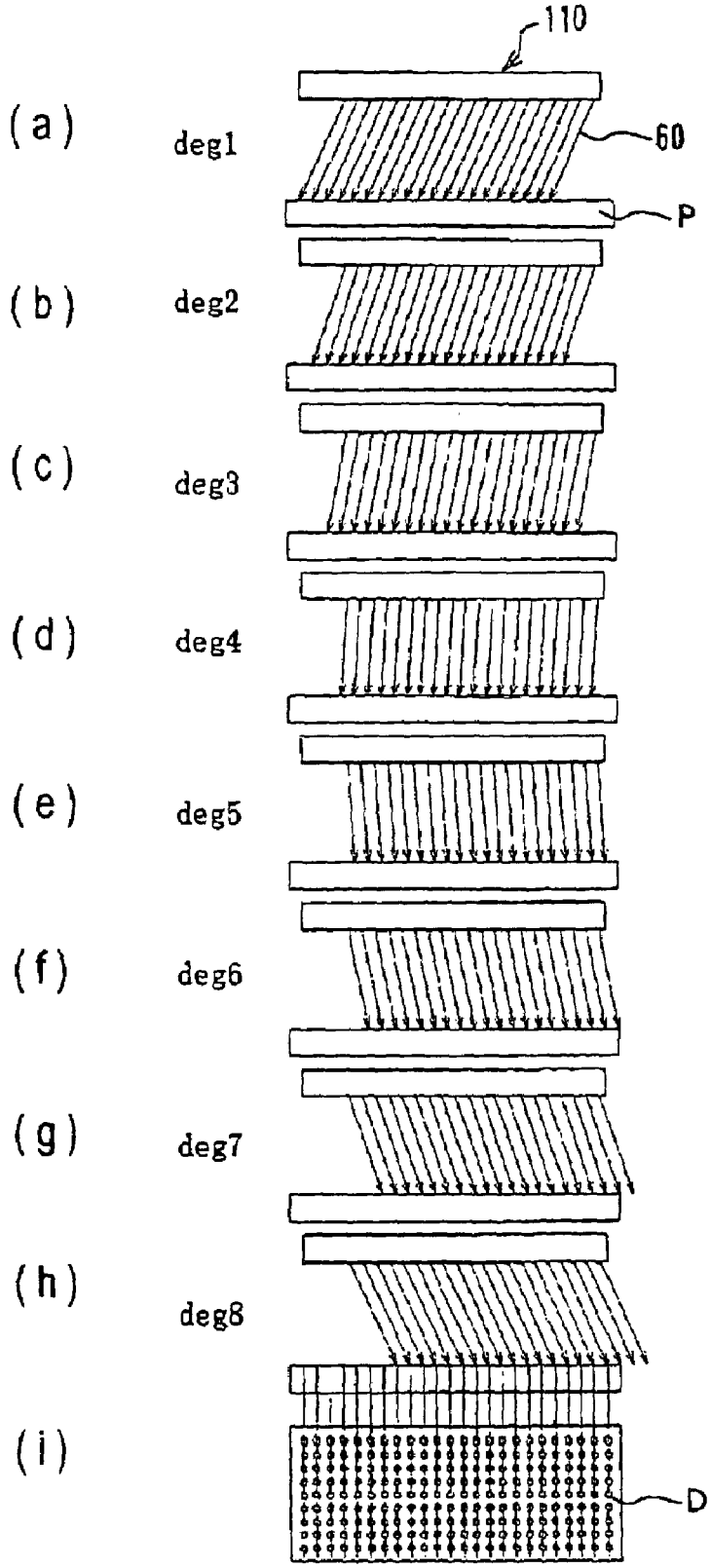
FIG. 14, consisting of FIGS 14A, 14B, 14C, 14D, 14E, 14F, 14G, 14H, AND 14I, is a general view showing a liquid discharging method according to an embodiment of the present invention in which ink droplets are discharged from a plurality of discharging portions provided in a print head while changing the discharging direction.

FIG. 14 is a general view showing a liquid discharging method according to an embodiment of the present invention. In the liquid discharging method, dots D or arrays of dots D are formed by discharging droplets from a plurality of discharging portions (not shown) in a head 110 while controlling the discharging direction.

The discharging states of ink droplets discharged from the discharging portions are checked, and information about a defective discharging portion is obtained. The defective discharging portion is prohibited from discharging, and droplets are discharged from the other discharging portions while controlling the discharging direction, thereby reducing the influence of discharging failure of the defective discharging portion. A specific configuration for carrying out the method will now be described in detail.

Figure 15:
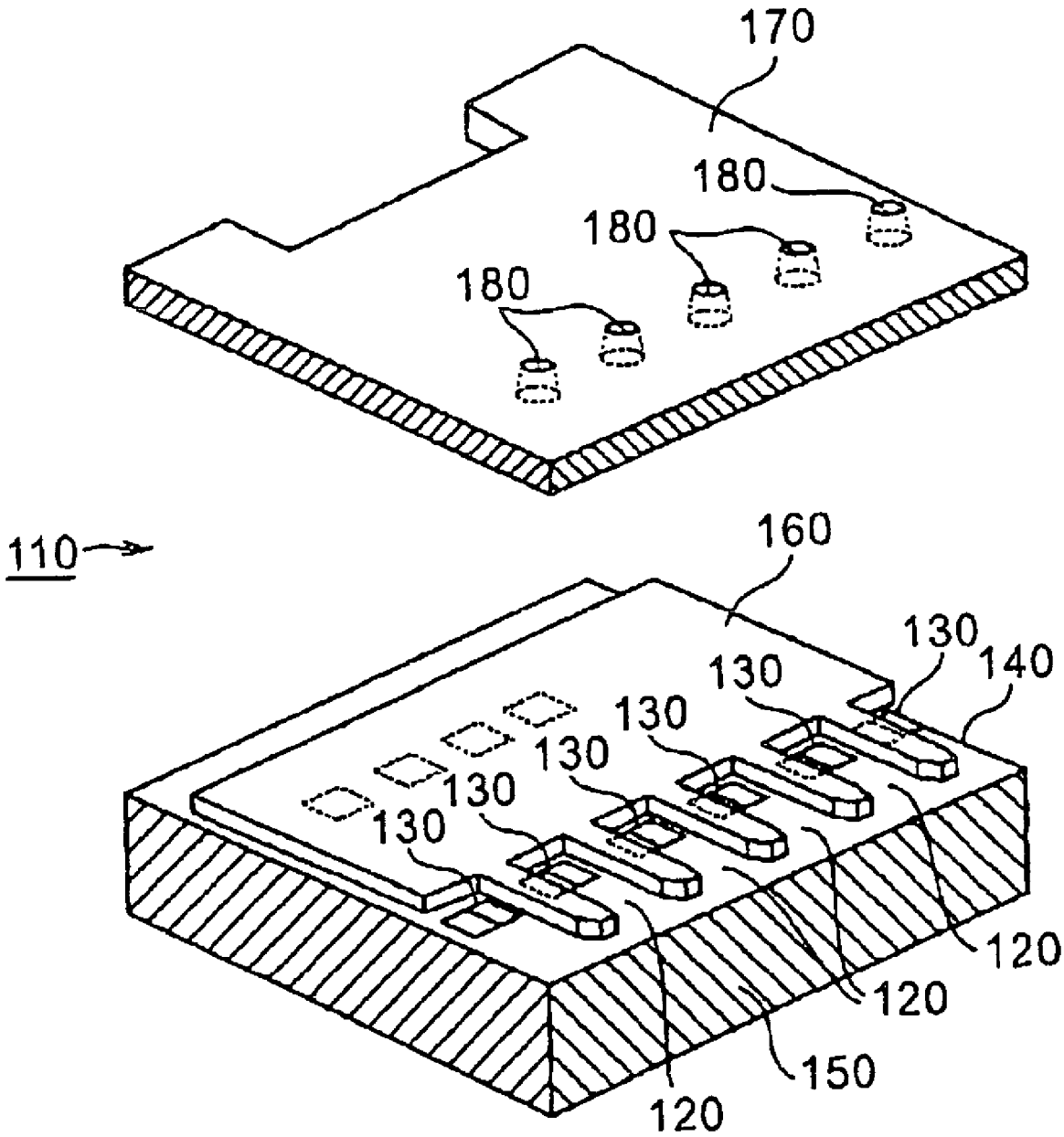
FIG. 15 is an exploded perspective view of a print head of an ink-jet printer serving as an apparatus directly used to carry out the liquid discharging method of the present invention.

FIG. 15 is an exploded perspective view of a print head 110 in an ink-jet printer serving as an apparatus that is directly used to carry out the liquid discharging method of this invention. A nozzle member 170, which will be described later, is bonded to a barrier layer 160, as shown in FIG. 15. In FIG. 15, the nozzle member 170 is separately shown.

The print head 110 is of a so-called thermal type in which a bubble is generated by heating ink in an ink chamber 120 with heating resistors 130 and the ink is discharged by the energy resulting from the generation of the bubble. The print head 110 includes a base member 140, the barrier layer 160, and the nozzle member 170. The base member 140 includes a semiconductor substrate 150 made of silicon or the like, and heating resistors 130 (corresponding to heating elements in the present invention) precipitated on one surface of the semiconductor substrate 150. The heating resistors 130 are electrically connected to an external circuit through a conductive portion (not shown) formed on the semiconductor substrate 150.

The barrier layer 160 is formed, for example, by applying a photocurable dry film resist on the overall surface of the semiconductor substrate 150 with the heating resistors 130, and removing unnecessary portions therefrom by a photolithographic process.

The nozzle member 170 has a plurality of nozzles (discharging outlets) 180, and is formed by, for example, nickel electroforming. The nozzle member 170 is bonded on the barrier layer 160 so that the nozzles 180 are aligned with the heating resistors 130, that is, so that the nozzles 180 oppose the heating resistors 130.

The ink chamber 120 is defined by the base member 140, the barrier layer 160, and the nozzle member 170 so as to surround the heating resistors 130. That is, in FIG. 15, the base member 150, the barrier layer 160, and the nozzle member 170 form, respectively, a bottom wall, a side wall, and a top wall of the ink chamber 120. Accordingly, the ink chamber 120 has an open face on the right front side in FIG. 15, and the open face communicates with an ink channel (not shown).

The single print head 110 normally includes a plurality of (hundreds of) heating resistors 130, and ink chambers 120 containing the heating resistors 130. In response to a command from a control unit in the printer, the heating resistors 130 are selectively operated to discharge ink in the ink chambers 120 corresponding thereto from the nozzles 180 opposing the ink chambers 120.

That is, ink is supplied from an ink tank (not shown) connected to the print head 110 into each ink chamber 120. By passing a pulse current through a heating resistor 130 in the ink chamber 120 for a short period, for example. 1 μsec to 3 μsec, the heating resistor 130 is rapidly heated. As a result, a bubble is produced in a part of the ink in contact with the heating resistor 130, and a certain volume of ink is pushed away by expansion of the bubble (ink boils). Consequently, a part of the ink, which has a volume equivalent to that of the pushed ink and is in contact with the nozzle 180, is discharged as a droplet from the nozzle 180 onto printing paper to form a dot.

In the following description, a "discharging portion" refers to a portion constituted by an ink chamber 120, a heating resistor 130 disposed inside the ink chamber 120, and a nozzle 180 disposed on the ink chamber 120. That is, the print head 110 shown in FIG. 15 has a plurality of discharging portions arranged side by side.

The print head 110 has a discharging-direction deflecting means for controlling the discharging direction of ink droplets. The discharging-direction deflecting means deflects the discharging direction of an ink droplet discharged from a nozzle 180 so that the ink droplet can land on or adjacent to a landing position of an ink droplet that is discharged from an adjacent nozzle 180 without being deflected. The discharging-direction deflecting means has the following structure.

Figure 16A:
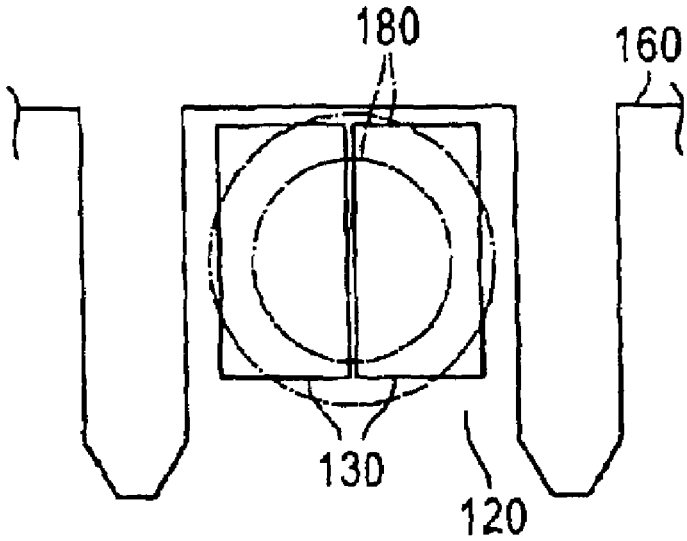
FIGS. 16A and 16B are a plan view and a sectional side view, respectively, showing the arrangement of heating resistors of the print head in more detail.
Figure 16B:
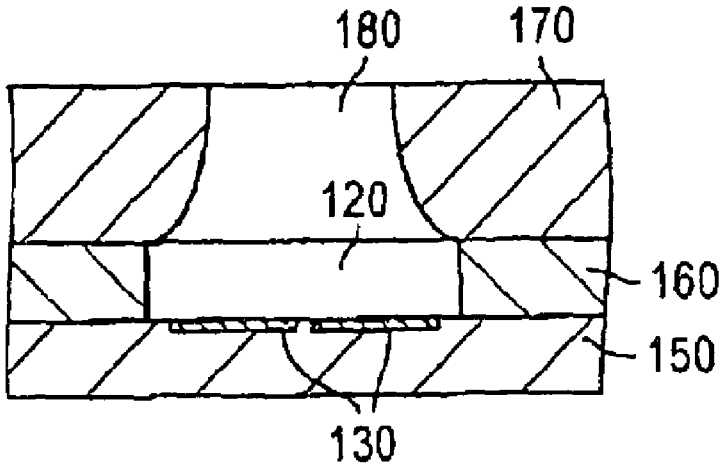

FIGS. 16A and 16B are a plan view and a sectional side view, respectively, showing the arrangement of the heating resistors 130 in the print head 110 in more detail. In FIG. 16A, the nozzle 180 is shown by one-dot chain lines.

In the print head 110 of this embodiment, two heating resistors 130 are disposed side by side in one ink chamber 120, as shown in FIGS. 16A and 16B. That is, one ink chamber 120 includes two split heating resistors 130. The heating resistors 130 are arranged in the same direction as the direction in which the nozzles 180 are arranged (right-left direction in the figures).

In a case in which one heating resistor is vertically split into two heating resistors 130 in this way, the length is not changed, but the width is halved. Therefore, the resistance of the heating resistors 130 is doubled. By connecting the two split heating resistors 130 having the double resistance in series, the resistance is quadrupled.

In order to boil ink in the ink chamber 120, the heating resistor 130 is needed to be heated by the application of a given current. This is because ink is discharged by the energy of boiling. Although a large current must be applied when the resistance is low, ink can be boiled with a small current by increasing the resistance of the heating resistor 130, as described above.

Consequently, the size of a transistor for applying a current can be reduced, and space saving can be achieved. While the resistance can be increased by reducing the thickness of the heating resistor 130, such thickness reduction is limited from the viewpoints of material and strength (durability) of the heating resistor 130. For this reason, the resistance is increased by splitting the heating resistor without reducing the thickness.

In a case in which two split heating resistors 130 are provided in one ink chamber 120, ink simultaneously boils on the two heating resistors 130 by causing the heating resistors 130 to reach the temperature for boiling ink in the same time (bubble generation time). This allows an ink droplet to be discharged in the direction of the center axis of the nozzle 180.

In contrast, when the bubble generation time is different between the two heating resistors 130, ink does not simultaneously boil thereon. In this case, a discharged ink droplet deviates from the center axis of the nozzle 180. Therefore, the ink droplet lands offset from the landing position of an ink droplet discharged without being deflected.

Figure 17:
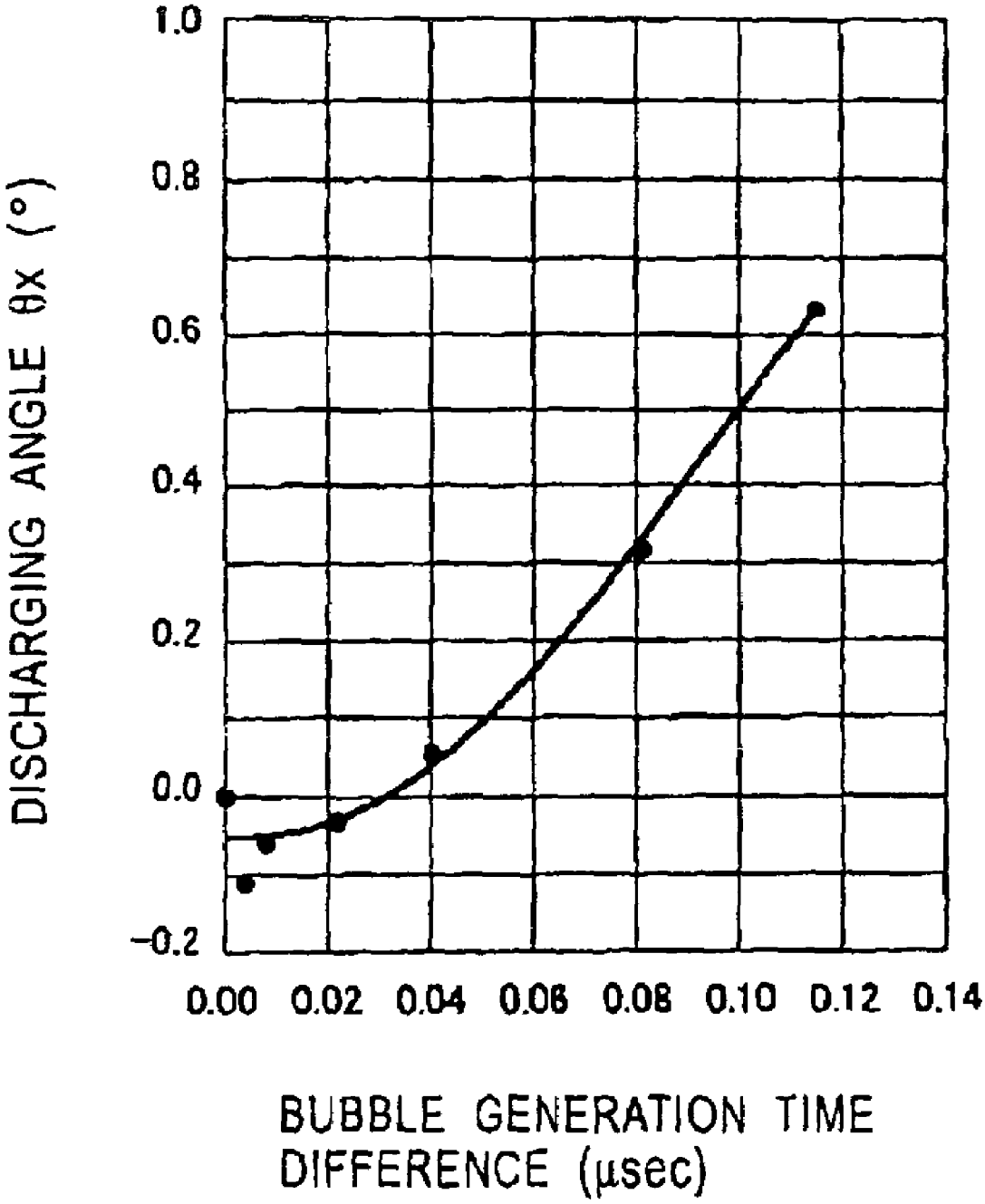
FIG. 17 is a graph showing the relationship between the difference in bubble generation time between two separate heating resistors in FIGS. 16A and 16B, and the ink-droplet discharging angle in the X-direction.
Figure 18:
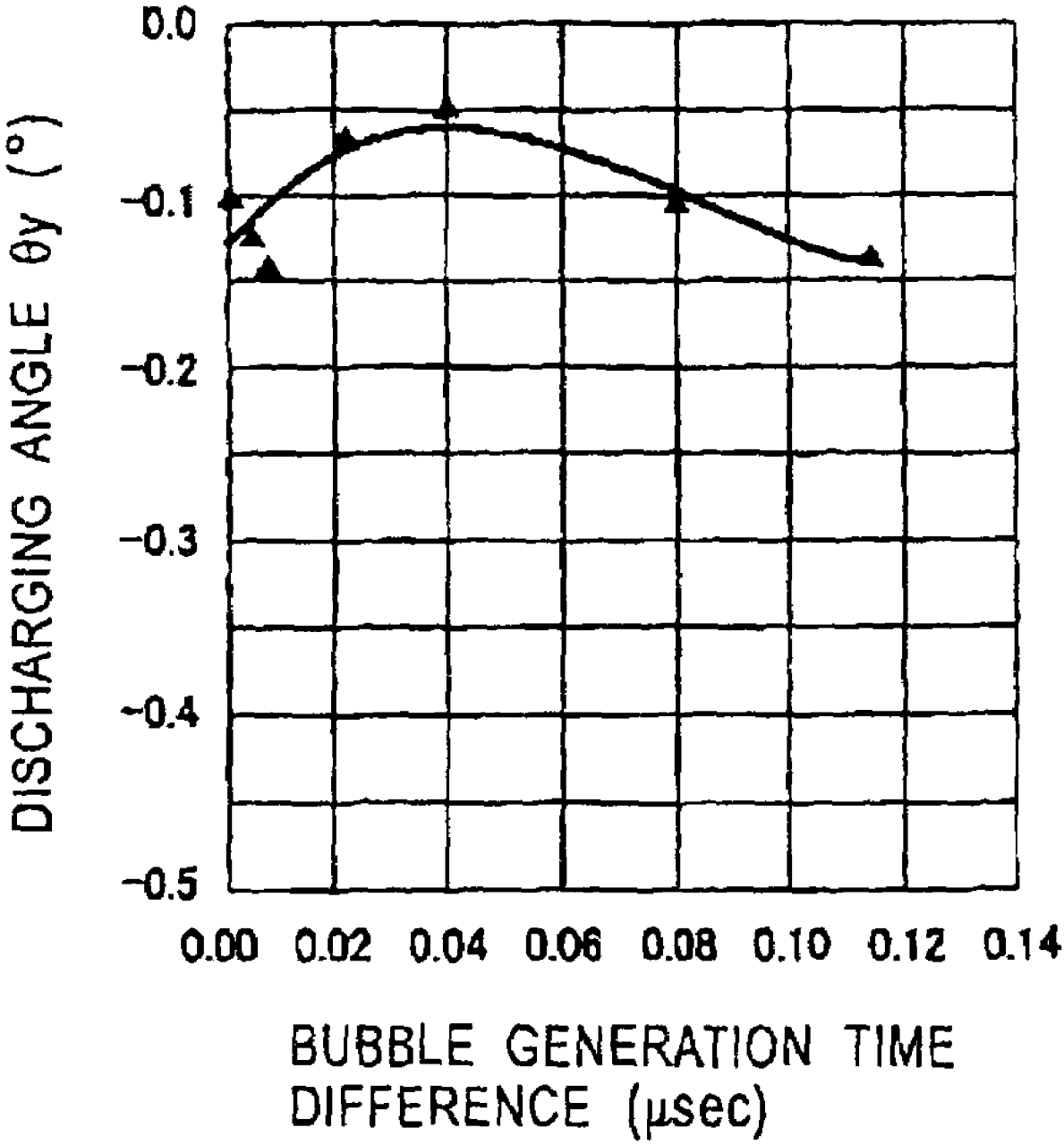
FIG. 18 is a graph showing the relationship between the difference in bubble generation time between the two split heating resistors in FIGS. 16A and 16B, and the ink-droplet discharging angle in the Y-direction.

FIG. 17 is a graph showing the relationship between the difference in bubble generation time between the two split heating resistors 130 shown n FIGS. 16A and 16B, and the discharging angle of ink droplets in the X-direction. FIG. 18 is a graph showing the relationship between the difference in bubble generation time, and the discharging angle of ink droplets in the Y-direction. Values in the graphs of FIGS. 17 and 18 are obtained by computer simulation. In these graphs, the X-direction refers to a direction in which the nozzles 180 are arranged (the heating resistors 130 are arranged side by side), and the Y-direction refers to a direction perpendicular to the X-direction (feeding direction of printing paper P). In both the X- and Y-directions, the angle shows the amount of offset of a discharged ink droplet from 0° serving as a direction at which the ink droplet is discharged without being deflected.

As shown in FIGS. 17 and 18, when there is a difference in bubble generation time between the heating resistors 130, the discharging angle of ink droplets deviates. Accordingly, in this embodiment, this characteristic is utilized. That is, the discharging angle of ink droplet is deviated by forming a difference in bubble generation time between the heating resistors 130, thereby controlling the discharging direction.

Figure 19:
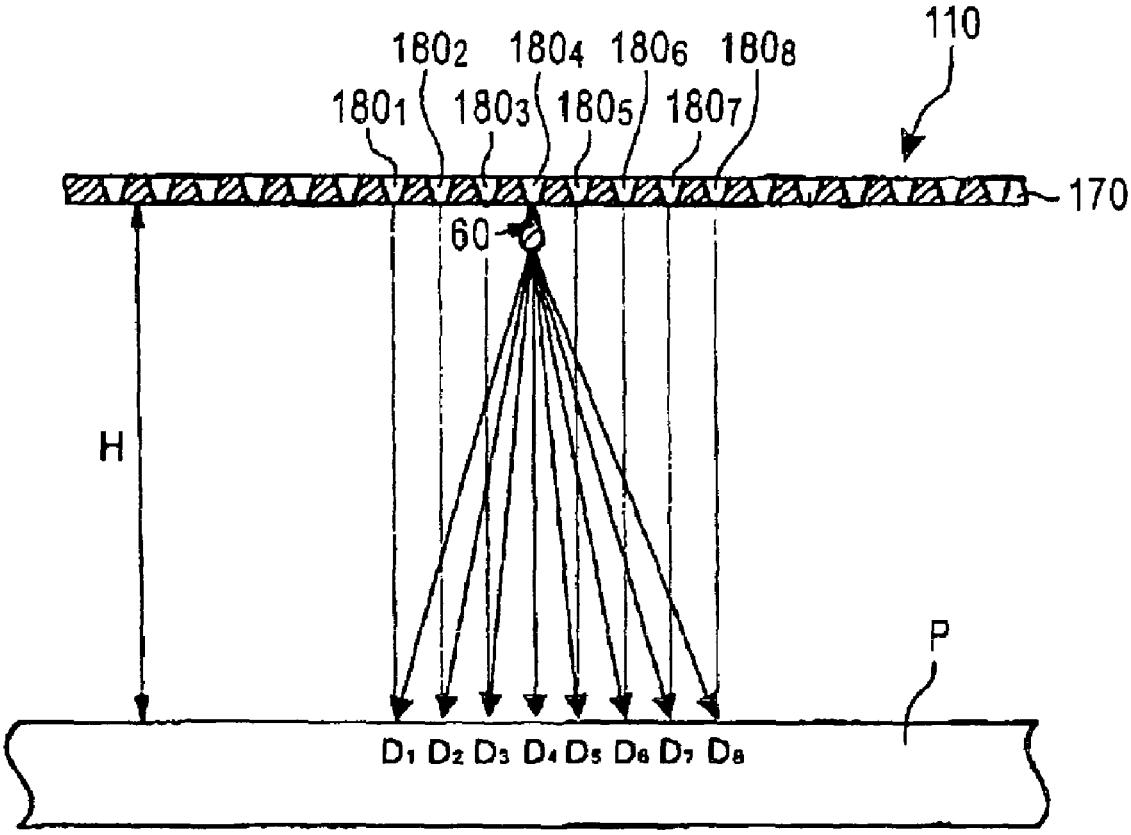
FIG. 19 is a sectional side view showing the relationship between the discharging directions of ink droplets from nozzles provided in a nozzle member of the print head, and printing paper.

With reference to FIG. 19, a description will be given of what degree to which the discharging angle of ink droplets can be adjusted. FIG. 19 is a sectional side view showing the relationship between the discharging angle of ink droplets 60 from the nozzles 180 of the nozzle member 170, and printing paper F. In FIG. 19, the distance H between the leading ends of the nozzles 180 and the printing paper P is approximately 1 mm to 2 mm in normal ink-jet printers.

When the resolution of the print head 110 is set at 600 dpi, the landing interval (dot interval) of the ink droplets 60 is given as follows:

$$25.40\times1000/600\approx42.3\ (\mu m)$$

In such a print head 110, the discharging direction of ink droplets 60 from each nozzle 180 is changed, for example, in eight steps by deflecting the discharging angle of the ink droplets 60. When it is assumed that ink droplets 60 are vertically discharged from eight adjoining nozzles $\mathbf{180}_1$, $\mathbf{180}_2$, . . . , $\mathbf{180}_8$ provided in the nozzle member 170 without deflecting the discharging angle, and that positions on the printing paper P on which the ink droplets 60 land are designated $D_3$ to $D_8$, the discharging direction is changed so that ink droplets 60 discharged from each nozzle 180, for example, a nozzle $\mathbf{180}_4$, land on the eight landing positions $D_1$ to $D_8$ on the printing paper P.

By thus discharging ink droplets 60 from a plurality of discharging portions (not shown) of the print head 110 while changing the discharging direction, as shown in FIGS. 14(*a*) to 14(*h*), the ink droplets 60 are caused to land on the printing paper P to form dots D or dot arrays D, as shown in FIG. 14(*i*). The discharging angle shown in FIG. 14(*a*) is designated deg1, and the discharging angle in FIG. 14(*b*) is designated deg2. The discharging angles in subsequent figures are similarly designated, and the discharging angle in FIG. 14(*h*) is designated deg8.

Figure 20:
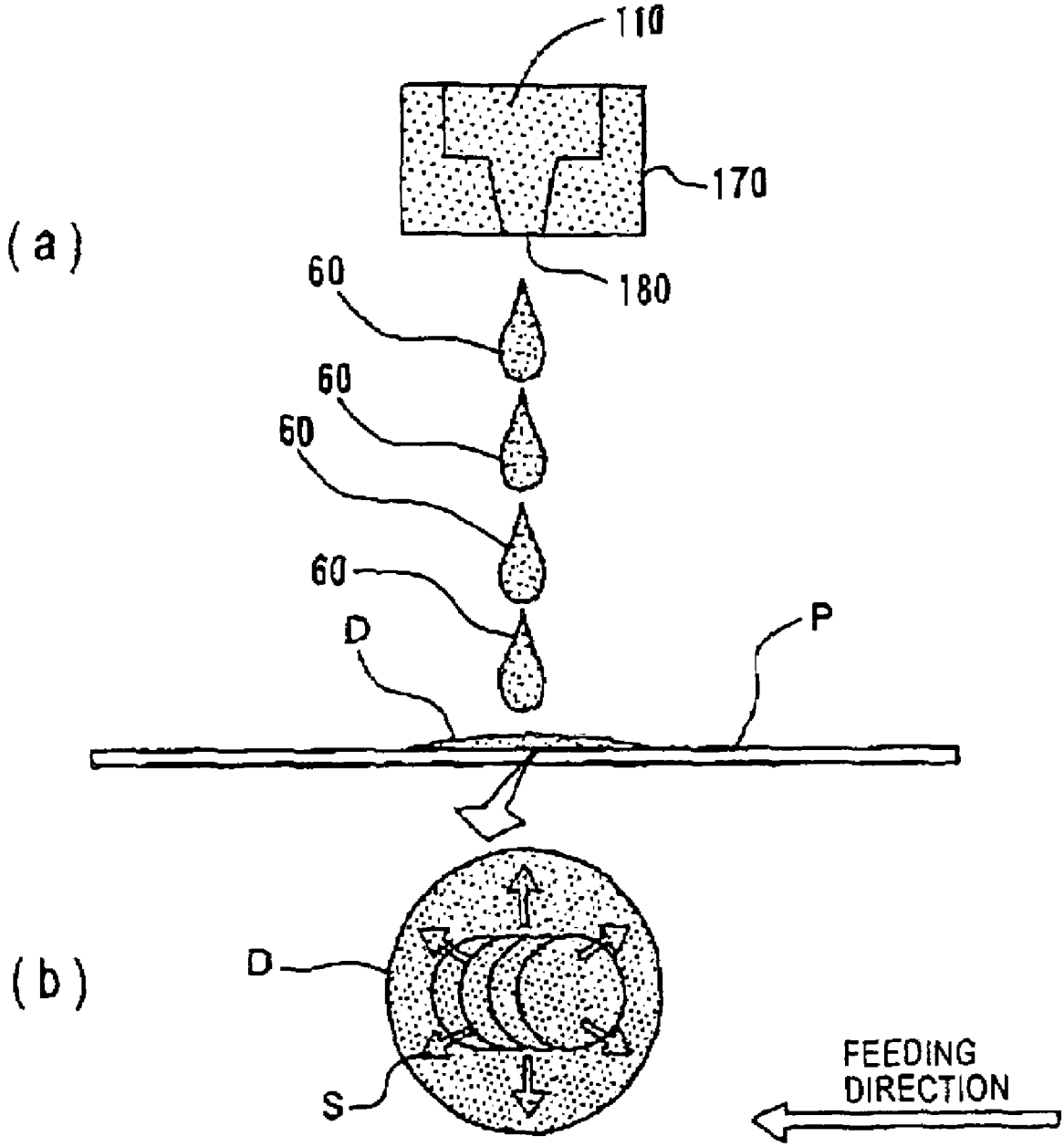
FIGS. 20(*a*) and 20(*b*) are explanatory views showing a state in which an image is formed on a recording medium by discharging ink droplets from a discharging portion of the print head.

The above-described print head 110 is a line head that adopts the above-described PNM method, as shown in FIG. 20. The print head 110 includes head sections for four colors, yellow Y, magenta M, cyan C, and black K, and is disposed so that the nozzles 180 for discharging ink droplets 60 face downward.

For plain explanation, a description will be given of a case in which, for example, only cyan ink is used without using yellow, magenta, and black inks. A maximum of seven droplets of one color can be discharged from each discharging portion, and six or less droplets are discharged to print one dot D on the printing paper P. The number of droplets that form one cyan dot can be changed from zero to eight by the PNM method, as described above. The amount of ink to be discharged is set at, for example, 3.5 pl.

In the following description, ink droplets 60 are discharged in response to PNM signals serving as droplet discharging signals. A driving timing for the first ink droplet 60 discharged from each discharging portion is designated PNM1, and a driving timing for the second ink droplet 60 is designated PNM2. Subsequent timings are similarly designated, and a driving timing for the seventh ink droplet 60 is designated PNM7.

Figure 21:
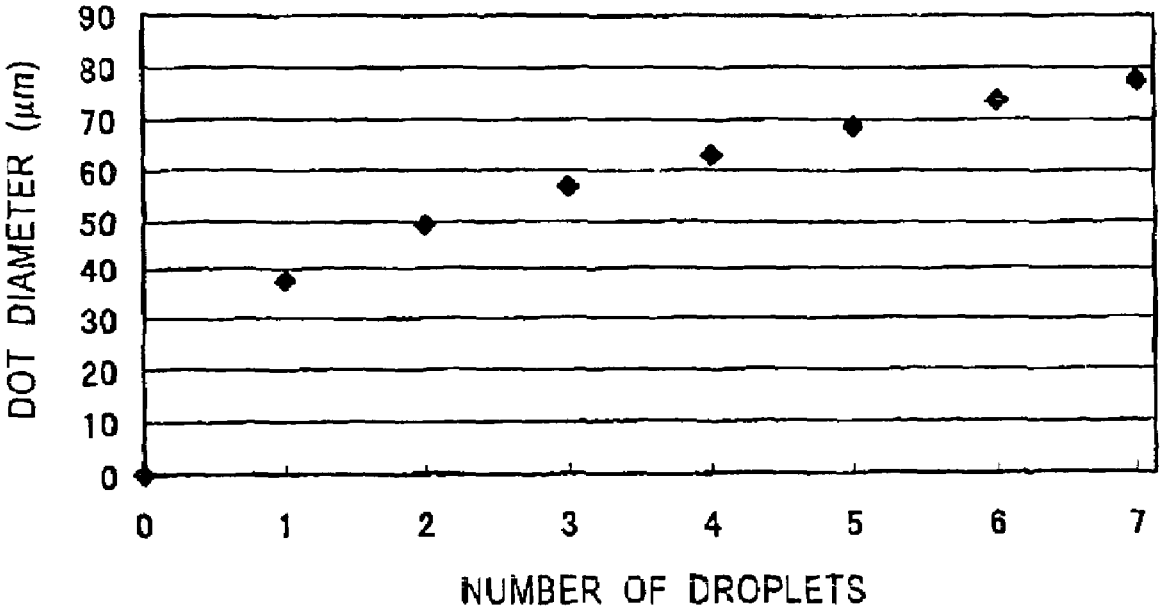
FIG. 21 is a graph showing the relationship between the number of ink droplets discharged from the discharging portion, and the dot diameter.

In such a state, as shown in FIG. 20(*a*), ink droplets 60 are discharged from a nozzle 180 of the print head 110 onto printing paper P serving as a recording medium. In this case, the discharged ink droplets 60 spread in the directions S to form one dot D, as shown in FIG. 20(*b*). Therefore, the size of the dot D gradually increases depending on the number of the ink droplets 60. FIG. 21 shows the relationship between the number of droplets and the dot diameter. The dot diameter increases from approximately 38 μm to approximately 79 μm as the number of droplets increases from 1 to 7. When the number of droplets is four, as shown in FIG. 21A, the dot diameter is approximately 63 μm.

Figure 25:
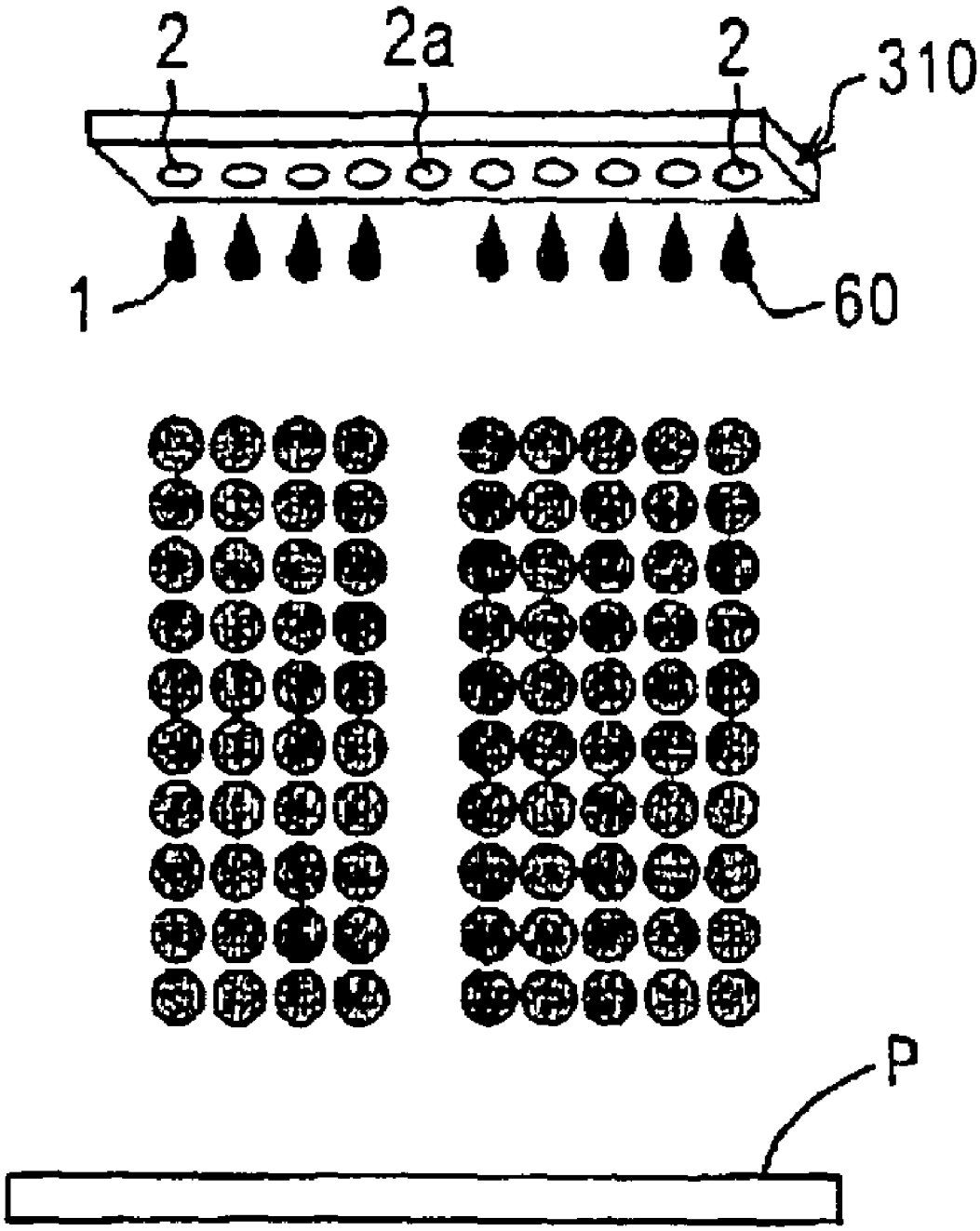
FIG. 25 is an explanatory view showing a state of a known ink-jet image forming apparatus in which an ink droplet is not discharged from a defective discharging portion.

With reference to FIG. 22, a description will be given of a liquid discharging method in which dots D or dot arrays are formed by discharging ink droplets 60 from the discharging portions of the print head 110 while changing the discharging direction and while changing the diameter of the dots D by the number of ink droplets 60. FIG. 22 is a table showing the relationship between dots D ($D_1$ to $D_9$) formed by PNM, and the discharging portions for discharging ink droplets 60 to form the dots D. In a known type of a print head 310 that does not change the discharging direction of ink droplets (see FIG. 25), ink droplets 60 are discharged from the same discharging portions from the driving timing PNM1 to the driving timing PNM7.

In contrast, in the liquid discharging method of this invention, ink droplets are discharged from different discharging portions to form each dot D, as shown in FIG. 22. That is, as shown in FIG. 14, ink droplets 60 are continuously discharged from a plurality of discharging portions (not shown) provided in the print head 110 while changing the discharging direction. The first ink droplets 60 are discharged at the discharging angle deg1 (see FIG. 14(*a*)), and the second ink droplets 60 are discharged at the discharging angle deg2 (see FIG. 14(*b*)). Subsequently, irk droplets 60 are similarly discharged from different discharging portions to form one dot D, thereby changing the dot diameter by PNM.

More specifically, for example, in order to form a dot $D_1$ in the A-th line, an ink droplet is discharged from the discharging portion (nozzle) $\mathbf{180}_1$ shown in FIG. 19 (hereinafter, the discharging portion $\mathbf{180}_1$ will be abbreviated as "DP1" in the table of FIG. 22, other discharging portions are similarly abbreviated) at a driving timing PNM1, an ink droplet is discharged from DP-1 on the left side of the DP1 (on the left side in FIG. 19, nozzle number is not shown) at PNM2, and an ink droplet is discharged from DP-2 on the left side of DP-1 at PNM3, as shown in FIG. 22. Subsequently, similar discharging is performed, and an ink droplet is discharged from DP-6 at PNM7. In this way, ink droplets are discharged from the different discharging portions at the driving timings PNM1 to PNM7, so that a dot $D_1$ in the A-th line is formed.

In order to form a dot $D_1$ n the next B-th line, an ink droplet is discharged from DP-7 at PNM1, and an ink droplet is discharged from DP1 at PNM2, in a manner different from that in the above-described dot $D_1$ in the A-th line. Subsequently, discharging is similarly performed, and an ink droplet is discharged from DP-5 at PNM7. In this way, the cycle in which the discharging portions are interchanged does not correspond to the PNM cycle.

Figure 26:
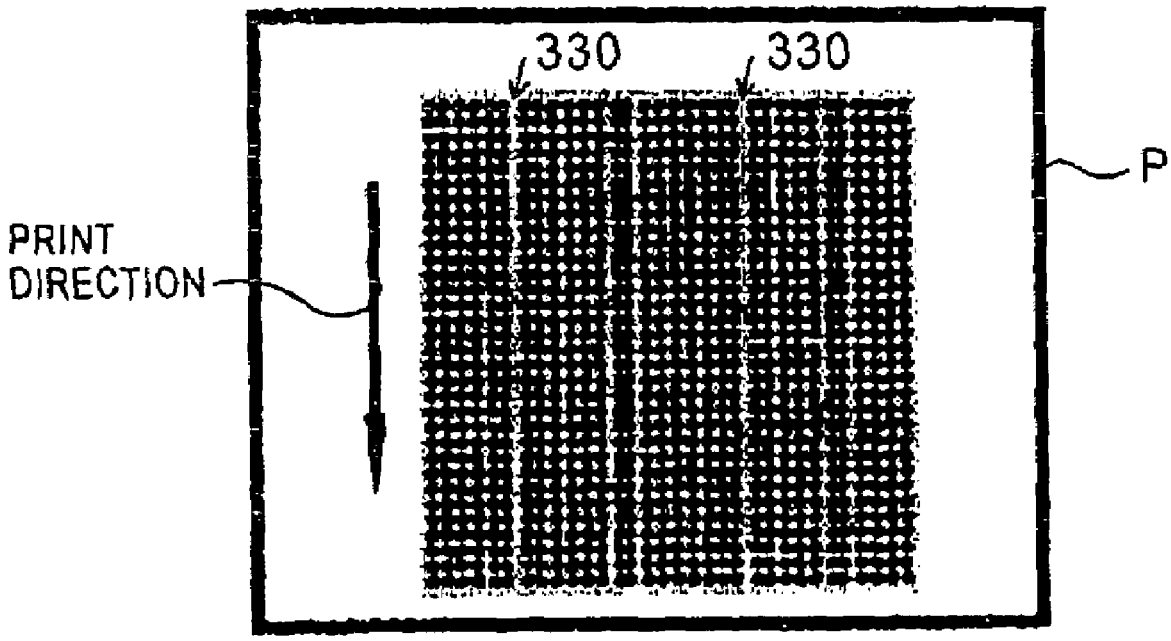
FIG. 26 is an explanatory view showing a state in which white stripes and dark stripes are formed on a recording medium by defective discharging portions of the print head shown in FIG. 25.

In a case in which the cycles correspond to each other, for example, when discharging at the driving timing PNM1 continues, an array of dots D from the dot $D_1$ in the A-th line to the dot $D_1$ in the F-th line are formed by ink droplets discharged from the same discharging portion, and a white stripe 330 (see FIG. 26) is likely to appear on the printing paper P.

In the above-described liquid discharging method in which dot arrays or dots are formed by discharging ink droplets from the discharging portions of the print head 110 while changing the discharging direction, first, an actual pattern that indicates the discharging states of ink droplets 60 from all the discharging portions is formed. For example, an actual pattern is printed on printing paper P by discharging ink droplets 60 from the discharging portions in the above-described PNM method without deflecting the discharging direction. In this case, when the ink droplets 60 are normally discharged from all the discharging portions, a normal pattern is formed in an image forming region of the printing paper P, although not shown.

In contrast, when any of the discharging portions is defective, ink does not adhere or insufficiently adheres to the printing paper P, and therefore, a pattern including white stripes 330 (see FIG. 26) or lightly colored portions is formed.

Information about the defective discharging portion is obtained by checking the actual pattern (not shown) for the discharging states of ink droplets 60. That is, it is determined, on the basis of the actual pattern formed by the above-described manner, whether a defective discharging portion exists. When it is determined that a defective discharging portion exists, information about, for example, the position of the defective discharging portion, the amount of discharged ink, and the number of discharging shots, is obtained. For example, when it is assumed that the nozzle 180, (discharging portion 1) shown in FIG. 19 is judged defective, the influence of discharging failure appears at the driving timing PNM1 for a dot $D_1$ in the A-th line in FIG. 22, the driving timing PNM2 for a dot $D_2$ in the A-th line, the driving timing PNM3 for a dot $D_3$ in the A-th line, . . . , and the driving timing PNML for a dot $D_9$ in the B-th line, and so on. In this case, lightly colored portions 350 shaped like stripes remain in a printed image (see FIG. 27), and this reduces the quality of the printed image.

The obtained information about the defective discharging portion 1 is stored in a storage section provided inside the print head 110 or inside an image processing unit 210 (FIG. 24) which will be described later, or is stored in a storage section provided inside an external control unit such as a host computer. Alternatively, the information may be stored in storage sections provided in some of the print head 110, the image processing unit 210, and the external control unit.

According to the information, the defective discharging portion 1 is prohibited from discharging, new droplet discharging signals are generated to reduce the influence of discharging failure of the defective discharging portion 1. By continuously discharging ink droplets from a nozzle 180 (FIG. 19) different from the defective discharging portion 1 while controlling the discharging direction according to the new droplet discharging signals, the diameter of dots D is changed to reduce the influence of discharging failure of the defective discharging portion 1. In this case, since it is determined that the nozzle $\mathbf{180}_1$ (discharging portion 1) shown in FIG. 19 is defective, the defective discharging portion 1 is prohibited from discharging, and ink droplets 60 are discharged from a discharging portion different from the defective discharging portion 1 according to new droplet discharging signals that is generated with reference to a correction table shown in FIG. 23.

FIG. 23 shows a correction table that lists new droplet discharging signals to be generated to remove the influence of discharging failure of a defective discharging portion, and is created beforehand. FIG. 23 shows a case in which the discharging portion 1 shown in FIG. 22 is defective. As shown in FIG. 23, droplet discharging signals (PNM1 to PNM7) for dots $D_1$ to $D_a$ from the A-th to F-th lines are changed in order to resolve the influence of discharging failure of the defective discharging portion.

More specifically, for example, in order to form a small-diameter dot D1 in the A-th line by discharging only one ink droplet 60 at the driving timing PNM1, the droplet discharging signal is changed from PNM1 to PNM2, as shown in FIG. 23. Consequently, an attempt is made to discharge an ink droplet 60 from the discharging portion 1 at the driving timing PNM1, and an ink droplet 60 is discharged from the discharging portion −1 at the driving timing PNM2. Since the defective discharging portion 1 is prohibited from discharging, as described above, in actuality, only one ink droplet 60 is discharged from the discharging portion −1, and a small-diameter dot D can be formed.

For example, in order to form a small-diameter dot $D_2$ in the A-th line by discharging only one ink droplet 60 at the driving timing PNM1, the droplet discharging signal remains PNM1. In this case, a dot is formed by discharging only one ink droplet 60 from the discharging portion 2, which is not defective, at the driving timing PNM1, as shown in FIG. 22.

In contrast, in order to form a dot $D_2$ in the A-th line by discharging two ink droplets 60 at the driving timing PNM2, the droplet discharging signal is changed from PNM2 to PNM3, as shown in FIG. 23. Consequently, an ink droplet 60 is discharged from the discharging portion 2 at the driving timing PNM1, an attempt is made to discharge an ink droplet 60 from the discharging portion 1 at the driving timing PNM2, and an ink droplet 60 is discharged from the discharging portion −1 at the driving timing PNM3, as shown in FIG. 22. Since the defective discharging portion 1 is prohibited from discharging, as described above, in actuality, a dot D can be formed by discharging two ink droplets 60 from the discharging portions 2 and −1 to form a dot D.

Since dots $D_9$ from the A-th to F-th lines are formed without discharging ink droplets from the defective discharging portion 1, as shown in FIG. 22, droplet discharging signals (PNM1 to PNM7) are not changed. As described above, the influence of discharging failure of the defective discharging portion can be resolved by continuously discharging ink droplets 60 from a discharging portion different from the defective discharging portion 1 while changing the discharging direction according to new droplet discharging signals generated with reference to the correction table shown in FIG. 23. In this case, lightly colored portions (see FIG. 27) do not remain on a print mage, and a high-quality print image can be formed.

While the reduction in quality of a print image is prevented by removing the influence of discharging failure of the defective discharging portion at all the driving timings PNM1 to PNM7 in the correction table shown in FIG. 23, correction may be made when the influence is particularly prominent. That is, new droplet discharging signals may be generated with reference to the correction table only when the diameter of a dot formed by ink droplets discharged from a discharging portion different from the defective discharging portion takes the minimum value or is close to the minimum value, for example, at the driving timing PNM1 or PNM2.

While discharging failure means that no ink droplets 60 are discharged from any of the discharging portions of the print head 110 in the above description, the present invention is not limited to such a case, and is also applicable to a case in which ink droplets 60 discharged from any discharging portion land outside the allowable region on printing paper P, or to a case in which the amount of ink discharged from any discharging portion is outside the allowable range.

Figure 27:
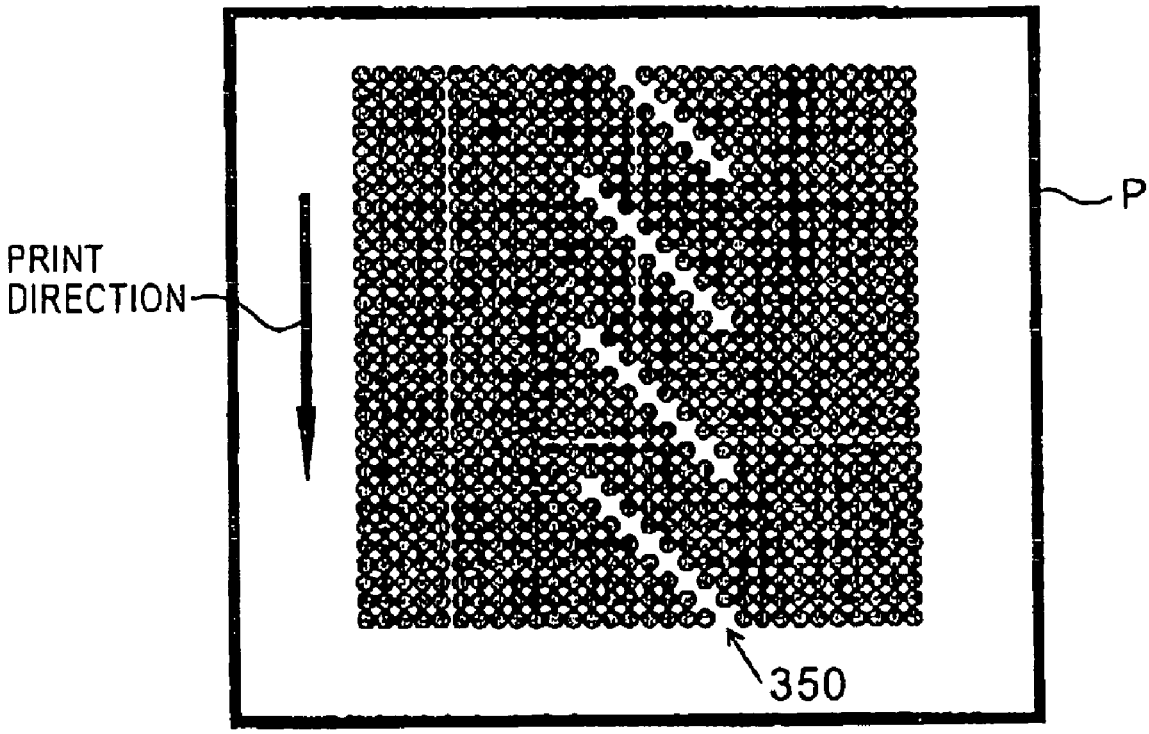
FIG. 27 is an explanatory view showing a state of another known print head in which lightly colored portions are formed on a recording medium by defective discharging portions.

In a case in which ink droplets 60 discharged from a defective discharging portion land outside the allowable region on printing paper P, they deviate from a predetermined direction, and lightly colored portions are formed in a print image, in a manner similar to that in FIG. 27. In a case in which the amount of ink discharged from a defective discharging portion is outside the allowable range, it is less than a predetermined amount, and lightly colored portions are formed on the printing paper P, although not shown.

While the amount of irk is controlled by discharging ink droplets 60 with PNM in the above description, in a print head having discharging portions each of which can change the discharging amount of ink, the discharging amount of ink itself may be controlled, or the amount of ink may be controlled by a combination of PNM and the method of changing the discharging amount.

Figure 24:
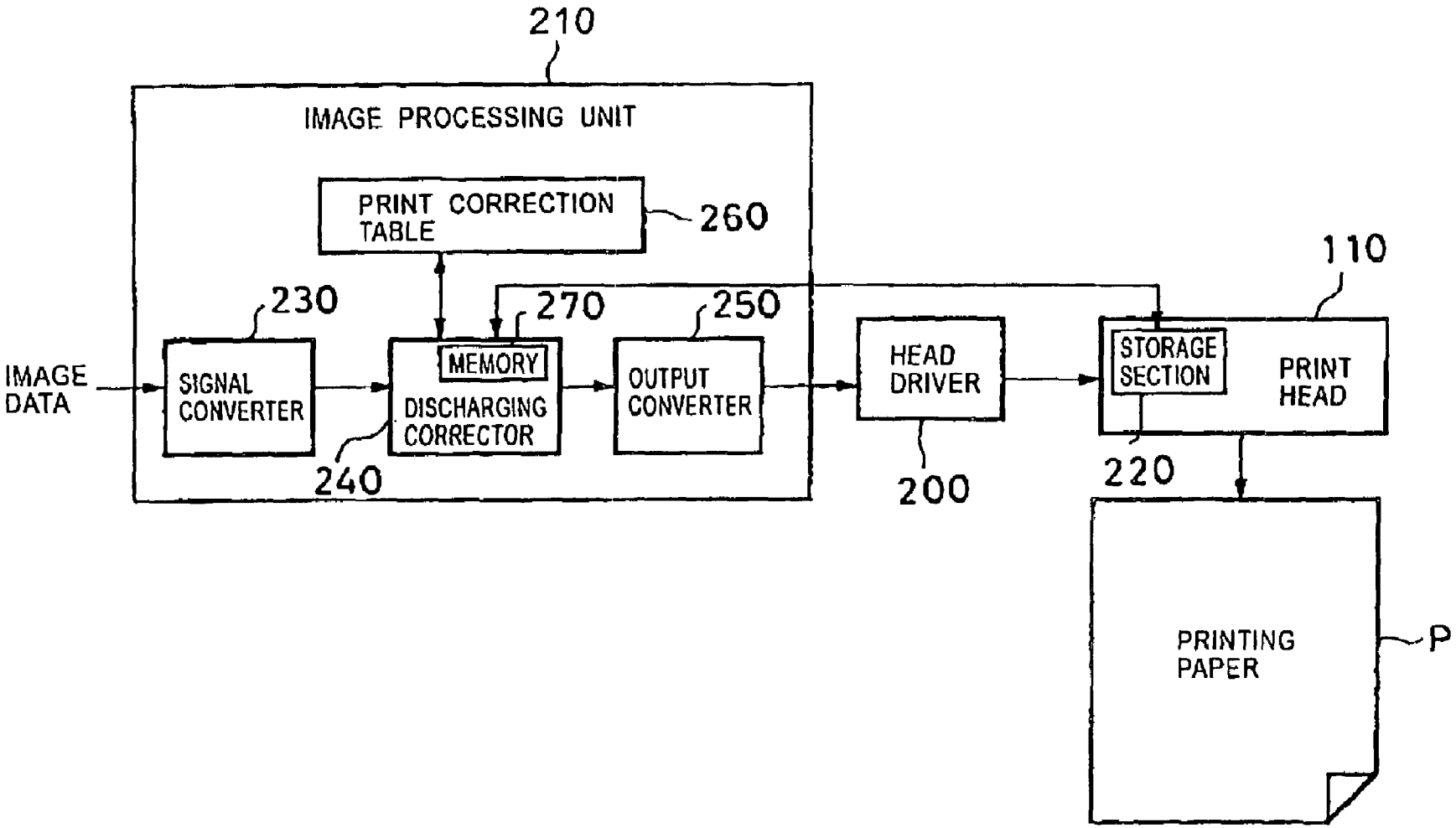
FIG. 24 is a block diagram of an image forming apparatus relating to the liquid discharging method of the present invention.

A description will be given of a liquid discharging apparatus relating to the above-described liquid discharging method as inventions relating to the above-described liquid discharging method (sixth, seventh, and eighth inventions), with reference to FIG. 24. An image forming apparatus serving as the liquid discharging apparatus is, for example, an ink-jet printer, and forms a print image on a recording medium by discharging ink droplets from a plurality of discharging portions provided in a print head onto the recording medium while changing the discharging direction. Referring to FIG. 24, the image forming apparatus includes a print head 110, a head driver 200, and an image processing unit 210.

The print head 110 actually discharges ink droplets onto printing paper P serving as a recording medium to print characters and images thereon, and has a plurality of discharging portions provided in a sheet-shaped nozzle member 170 to discharge ink droplets 60, as shown in FIG. 15. Each of the discharging portions includes a nozzle (discharging outlet) 180 formed in the nozzle member 170, and a heating element 130 serving as a driving element for heating and discharging ink in an ink chamber (not shown). A storage section 220 is provided inside the print head 110 to check an actual pattern which indicates the discharging states of ink droplets 60 from all the discharging portions, and to store information about a defective discharging portion.

The head driver 200 controls the driving of the print head 110 by fetching driving signals from the image processing unit 210, which will be described later, and supplying ON and OFF signals for driving control to the print head 110.

The image processing unit 210 processes externally input image data, converts the data into head-driving data for driving the print head 110, and sends the converted data to the head driver 200. The image processing unit 210 includes a signal converter 230, a discharging corrector 240, an output converter 250, and a print correction table 260.

The signal converter 230 receives externally input image data, and converts the image data into multilevel data having a number of colors and a number of levels in accordance with the performance of the overall liquid discharging apparatus by performing, as necessary, data decompression, rasterizing, scaling, color conversion, limitation of the amount of ink, gamma correction, or tone correction such as error diffusion, on the basis of print information such as a selected image formation mode or the type of a recording medium (printing paper P). The print information, such as the image formation mode and the type of printing paper, is sometimes added to a header of the input image data, and is sometimes directly supplied from an input panel (not shown) of the apparatus. In a case in which new print information is not given, the same information as that in the previous print operation or default information may be used.

The discharging corrector 240 inputs the multilevel data converted by the signal converter 230, and corrects the data so that the influence of discharging failure of a defective discharging portion 1 (see FIG. 22) hardly appears on the printing paper P, on the basis of information about the defective discharging portion 1 read from the storage section 220 in the print head 110 (e.g., the position of the defective discharging portion 1 and the type of discharging failure) and print information (image formation signals) read from the print correction table 260 which will be described later. A memory 270 is provided in the discharging corrector 240 to store discharging information read from the storage section 220. This allows the discharging information to be read from the storage section 220 and stored in the memory 270 when the print head 110 is mounted or the power is turned on. Therefore, the discharging information does not need to be read from the storage section 220 in every operation, and can be normally read from the memory 270.

The output converter 250 functions as an output converting means for converting multilevel data corrected by the discharging corrector 240 into driving signals for the head driver 200. The output converter 250 converts the multilevel data into ON and OFF signals for actually driving the head driver 200.

The print correction table 260 lists and stores new droplet discharging signals generated to reduce the influence of discharging failure of the defective discharging portion, as described with reference to FIGS. 22 and 23.

The liquid discharging apparatus having such a configuration operates in a manner similar to that in the liquid discharging method described with reference to FIGS. 14 to 23. That is, first, the print head 110 is driven under the control of the head driver 200 shown in FIG. 24, and an actual pattern (not shown) that indicates the discharging states of ink droplets 60 from all the discharging portions 4 in the print head 1110 corresponding to an image forming region on the printing paper P is printed on the printing paper P by discharging ink droplets 60 in the above-described PNM method without deflecting the discharging direction.

When ink droplets 60 are normally discharged from all the discharging portions, a normal pattern is printed on in the image forming region on the printing paper P, although not shown. In contrast, when any of the discharging portions is defective, a pattern is printed on the printing paper P, in which ink does not adhere at all or adheres insufficiently corresponding to the defective discharging portion, and white stripes 330 (see FIG. 26) or lightly colored portions are formed.

Then, the discharging states of ink droplets 60 are checked on the basis of the printed actual pattern, and information about the defective discharging portion is stored in the storage section 220 in the print head 110 shown in FIG. 24. The information includes, for example, print information such as the position of the defective discharging portion, and the discharging amount of ink. The information is recorded in, for example, shipping inspections.

During actual printing on the printing paper P, the discharging corrector 240 in the image processing unit 210 shown in FIG. 24 reads out the information about the defective discharging portion 1 (see FIG. 22) from the storage section 110 in the print head 110, and prohibits the defective discharging portion 1 from discharging ink droplets. Subsequently, on the basis of the information about the defective discharging portion 1 and corrected print information (droplet discharging signals serving as image formation signals) read from the print correction table 160, the discharging corrector 240 controls the discharging of ink droplets 60 from discharging portions different from the defective discharging portion 1 so that the influence of discharging failure of the defective discharging portion 1 hardly appears on the printing paper P.

In this state, the corrected print information is 250 15, and is sent to the head driver 200. The head driver 200 supplies the input driving signals to the print head 110 to control an actual printing operation on the printing paper P. Consequently, as described with reference to FIGS. 22 and 23, ink droplets 60 are discharged from the discharging portions different from the defective discharging portion 1 while changing the discharging direction according to the print information as new droplet discharging signals, the influence of discharging failure of the defective discharging portion is resolved, and a print image on the printing paper P is corrected. Therefore, the influence of discharging failure on the image quality can be removed, and the print head 110 can be used even when any of the discharging portions is defective. As a result, the production yield of the print head 110 can be enhanced.

While the storage section 220 is provided inside the print head 110 in FIG. 24, it may be provided inside the image processing unit 210. Alternatively, the storage section 220 may be provided inside an external control unit such as a host computer, or may be provided inside some or all of the print head 110, the image processing unit 210, and the external control unit.

The above-described image forming apparatus, such as an ink-jet printer, serving as the liquid discharging apparatus can be achieved by applying the image forming method described with reference to FIGS. 14 to 23 to the ink-jet printer shown in FIGS. 12 and 13.

While the embodiments corresponding to the fourth, fifth, sixth, seventh, and eighth inventions have been described above, it is to be understood that the invention is not limited to the disclosed embodiments. On the contrary, the invention is intended to cover various modifications and equivalent arrangements included within the spirit and scope of the appended claims. For example, while a difference is formed in the time in which ink droplets boil on the two split heating resistors 130 (bubble generation time) between the heating resistors 130 by varying the current to be passed through the heating resistors 130, in addition, a difference may be formed in the time in which a current is passed through the two heating resistors 130.

In the above embodiments, two split heating resistors 130 are arranged side by side in one ink chamber 120 because it is sufficiently verified that such splitting into two ensures endurance, and the circuit configuration can be simplified. However, three or more heating resistors 130 may be arranged side by side in one ink chamber 120.

While the printer head and the line head in the above embodiments are used in printers, they may be applied not only to the printers, but also to various liquid discharging apparatuses. For example, the heads may be applied to an apparatus that discharges a DNA-containing solution in order to detect biological samples. Furthermore, the heating resistors 130 in the embodiments may be replaced with heating elements other than resistors.

What is claimed is:

1. A liquid discharging method for forming dot arrays or dots on a recording medium by discharging droplets from a plurality of liquid discharging portions while controlling the discharging direction and angle, and changing the dot diameter based on the number of the discharged droplets, the liquid discharging portions comprising a liquid chamber containing liquid to be discharged and a plurality of heating elements arranged in a predetermined direction inside the liquid chamber to generate a bubble in the liquid in the liquid chamber by the application of energy so that the liquid is discharged from a liquid discharging outlet, and the method comprising the steps of:

obtaining information about a defective liquid discharging portion having discharging failure by checking the discharging states of the droplets discharged from the liquid discharging portions;

prohibiting the defective liquid discharging portion from discharging and generating new droplet discharging signals for reducing the influence of the discharging failure of the defective liquid discharging portion; and discharging droplets from a liquid discharging portion different from the defective liquid discharging portion while controlling the discharging direction and angle by forming a bubble generation time difference by applying a difference in energy between at least one of the heating elements and at least another one of the heating elements so as to control the discharging direction and angle of the liquid discharged from the liquid discharging outlet based on the value of the bubble generation time difference, according to the new droplet discharging signals;

wherein the new droplet discharging signals are generated only when the diameter of the dots formed on the recording medium by the droplets discharged from the liquid discharging portion different from the defective liquid discharging portion takes a minimum value or is close to the minimum value.

2. A liquid discharging method according to claim 1, wherein the new liquid discharging signals are generated on the basis of a previously created table.

3. A liquid discharging method according to claim 1, wherein the discharging failure means that no droplets are discharged from the defective liquid discharging portion.

4. A liquid discharging method according to claim 1, wherein the discharging failure means that the discharging direction from the defective liquid discharging direction deviates from an allowable range.

5. A liquid discharging method according to claim 1, wherein the discharging failure means that the amount of liquid in the droplets discharged from the defective liquid discharging portion is outside an allowable range.

6. A liquid discharging apparatus for forming dot arrays or dots on a recording medium by discharging droplets from a plurality of liquid discharging portions onto the recording medium while controlling the discharging direction and angle, and changing the dot diameter by the number of the discharged droplets, the apparatus comprising:

a liquid discharging head having the liquid discharging portions, wherein each of the liquid discharging portions comprises a liquid chamber containing liquid to be discharged and a plurality of heating elements arranged in a predetermined direction inside the liquid chamber to generate a bubble in the liquid in the liquid chamber by the application of energy so that the liquid is discharged from a liquid discharging outlet;

a head driver for controlling the driving of the liquid discharging head;

a processing unit that converts externally input signals into droplet discharging signals for driving the liquid discharging head and sends the droplet discharging signals to the head driver;

a storage section for storing information about a defective liquid discharging portion, the information being obtained by checking the discharging states of the droplets discharged from the liquid discharging portions; and a discharging corrector for generating new droplet discharging signals to reduce the influence of discharging failure of the defective discharging portion, wherein the influence of discharging failure of the defective droplet discharging portion is reduced by prohibiting the defective liquid discharging portion from discharging according to the information about the defective liquid discharging portion, and discharging droplets from a liquid discharging portion different from the defective liquid discharging portion while controlling the discharging direction and angle by forming a bubble generation time difference by applying a difference in energy between at least one of the heating elements and at least another one of the heating elements so as to control the discharging direction and angle of the liquid discharged from the liquid discharging outlet based on the value of the bubble generation time difference, according to the new droplet discharging signals generated by the discharging corrector so as to change the dot diameter;

wherein the new droplet discharging signals are generated only when the diameter of the dots formed on the recording medium by the droplets discharged from the liquid discharging portion different from the defective liquid discharging portion takes a minimum value or is close to the minimum value.

7. A liquid discharging method according to claim 6, wherein the new liquid discharging signals are generated on the basis of a previously created table.

8. A liquid discharging apparatus according to claim 6, wherein the storage section is provided inside the liquid discharging head, inside the processing unit, or inside an external control unit.

9. A liquid discharging method according to claim 6, wherein the discharging failure means that no droplets are discharged from the defective liquid discharging portion.

10. A liquid discharging method according to claim 6, wherein the discharging failure means that the discharging direction from the defective liquid discharging direction deviates from allowable range.

11. A liquid discharging method according to claim 6, wherein the discharging failure means that the amount of liquid in the droplets discharged from the defective liquid discharging portion is outside an allowable range.

12. A liquid discharging apparatus according to claim 6, wherein each of the liquid discharging portions comprises:

a liquid chamber containing liquid to be discharged; and a plurality of energy-generating elements arranged in a predetermined direction inside the liquid chamber to generate energy for causing the liquid in the liquid chamber to be discharged from a liquid discharging opening, wherein a difference in energy to be generated is formed between at least one of the energy-generating elements and at least another one of the energy-generating elements so as to control the discharging direction of the liquid discharged from the liquid discharging opening.

13. A liquid discharging method according to claim 1, wherein the liquid chamber comprises a pair of heating elements which simultaneously generate energy for causing the liquid in the liquid chamber to be discharged from the liquid discharging outlet.

14. A liquid discharging method according to claim 6, wherein the liquid chamber comprises a pair of heating elements which simultaneously generate energy for causing the liquid in the liquid chamber to be discharged from the liquid discharging outlet.

* * * * *